US005625948A

United States Patent [19]

Kuroda et al.

[11] Patent Number: 5,625,948

[45] Date of Patent: May 6, 1997

[54] METHOD FOR PRODUCING A PIPE AND APPARATUS FOR THE SAME

[75] Inventors: Yoshitaka Kuroda, Anjo; Makoto Ito, Kariya; Nobuyuki Morikawa, Toyoake; Ryoiti Izumi, Okazaki; Kenji Ogura, Kariya, all of Japan

[73] Assignee: Nippondenso Co., Ltd., Kariya, Japan

[21] Appl. No.: 631,211

[22] Filed: Apr. 12, 1996

[30] Foreign Application Priority Data

| | | | |
|---|---|---|---|
| Apr. 14, 1995 | [JP] | Japan | 7-089277 |
| Sep. 20, 1995 | [JP] | Japan | 7-241808 |
| Feb. 20, 1996 | [JP] | Japan | 8-032188 |

[51] Int. Cl.[6] ..... B21D 7/06

[52] U.S. Cl. ..... 29/890.149; 72/369

[58] Field of Search ..... 72/369; 29/890.149

[56] References Cited

U.S. PATENT DOCUMENTS

| | | | |
|---|---|---|---|
| 2,500,890 | 3/1950 | Wurzburger | 29/890.149 |
| 2,963,778 | 12/1960 | Dolby | 29/890.149 |
| 3,453,857 | 7/1969 | Reckard | 72/369 |

FOREIGN PATENT DOCUMENTS

| | | |
|---|---|---|
| 61-137629 | 6/1986 | Japan . |
| 4-220120 | 8/1992 | Japan . |
| 6-114454 | 4/1994 | Japan . |
| 6-262282 | 9/1994 | Japan . |
| 1050171 | 12/1966 | United Kingdom . |

*Primary Examiner*—Lowell A. Larson

*Attorney, Agent, or Firm*—Cushman, Darby & Cushman IP Group of Pillsbury Madison & Sutro LLP

[57] ABSTRACT

According to the present invention, in the first process, a pipe end of a long pipe is bent with a radius of curvature which is larger than a minimum radius of curvature to form a large R portion. That is to say, bending with a large radius of curvature (R) is performed to form a large R portion in a region in which cracking or excessive reduction of plate thickness of the bend outer-side portion, or buckling of the bend inner-side portion does not occur. Subsequently, in the second process, the pipe is bent with a small radius of curvature form a small R portion by pressing a pipe-end portion of the pipe from a pipe-end direction while fixedly holding the bend side wall of the pipe. In this way, it is possible to obtain an R-minimum elbow configuration irrespective of magnitude of an amount of elongation of material and further without special equipment or mechanisms, by minor modification of present equipment.

23 Claims, 28 Drawing Sheets

104
103
103a
103b
103c
100a
100
102b
102a
102

104
103
103a
100b
100c
102

104
103
100d
100b
100e
102

106
107
105
105a
105b
100b
100
102

106
107
105
102

106
107
105
100f
102

METHOD FOR PRODUCING A PIPE AND APPARATUS FOR THE SAME

CROSS REFERENCE TO THE RELATED APPLICATIONS

This application is based on and claims priority of Japanese Patent Application Nos. Hei 7-89277 filed on Apr. 14, 1995, Hei 7-241808 filed on Sep. 20, 1995, and Hei 8-32188 filed on Feb. 20, 1996, the content of which are incorporated herein by reference.

BACKGROUND OF THE INVENTION

1. Field of the Invention

The present invention relates to a method of producing a pipe used for, for example, a heat exchanger or the like, by bending or the like, and also relates to an apparatus for implementing the same.

2. Description of Related Art

In recent years, space allocated to piping for the heat exchanger has a tendency to be reduced due to higher density within an engine room of an automobile and to increasing complexity of various types of heat exchangers of coolers or the like.

Additionally, under these circumstances, there has been a demand for minimizing the dead space for piping (space required for bending) and the bend R of the piping (i.e., radius of curvature of piping) to improve degree of freedom in piping layout.

However, when the bend R is made smaller in a bending process for piping, there occur problems that plate thickness of an outer-side portion of the bent pipe (hereinafter referred to as "a bend outer-side portion") may be excessively reduced and an inner-side portion of the bent pipe (hereinafter referred to as a "bend inner-side portion") may buckle.

That is to say, bending of a pipe is ordinarily performed using a pipe bender or the like, but a minimum radius of curvature is determined by a rate of elongation of pipe material, pipe outer diameter, pipe pad thickness, and the like, and there exists a problem that, when the pipe is bent with the minimum radius of curvature or less, the pipe is crushed, thus making impossible to perform bending.

To overcome such problem, an R-minimum elbow part can be obtained by joining two parts as shown in, for example, FIGS. 10A and 10B, however, there exist problems of an increase in work processes, a large increase in cost, and unsuitability for mass-production.

Additionally, separately from this, the technology disclosed in JP-A-61-137629 has been proposed for the purpose of reducing the cost and adopting in mass production. In this art, the pipe is bent while an elastic body is disposed within the pipe, and thereby making possible to perform bending of a small radius, however, there exists a problem that the troublesomeness of work is increased. That is to say, this method requires operations to insert and remove the elastic body, such as an operation for inserting the elastic body in advance in the pipe to be bent, an operation for maintaining the elastic body from a pipe end in opposition to the other pipe end to be machined in order to support the inserted elastic body, and an operation for removing the elastic body after machined, thereby causing problems that work efficiency may decline and cost may increase. Additionally, because it is necessary to maintain the elastic body, there also exist the problem that it is impossible to apply to parts with many bend points.

Furthermore, there have been proposed a method for performing spool machining to shape a curved portion after forming a pipe intermediate body provided with a curved portion as disclosed in JP-A-6-262282 and a method for performing bending by a workpiece which is shifted by sliding forward during bending in a clamp portion including a bending die and a clamping die as disclosed in JP-A-4-220120 or the like. Although each method may be effective with regard to preventing buckling of the bend inner side and enhancing circularity as one of problems for the minimum-R bending, it is impossible to prevent the cracking of the bend outer side as another problem. That is to say, because the formable minimum-bend R is determined by the intrinsic elongation rate of the material, it is possible to apply to materials with a large amount of elongation, such as stainless steel or mild steel, however, it is impossible to apply to material with small material elongation such as aluminum.

SUMMARY OF THE INVENTION

In view of the above-described problems, it is an object of the present invention to provide a method for producing a pipe and an apparatus for implementing the same to obtain an R-minimum elbow configuration irrespective of magnitude of an amount of elongation of material and further without special equipments or mechanisms such as for inserting the elastic body, i.e., by minor modification of the present equipment.

According to the present invention, in the first process, a pipe end of a long pipe is bent with a radius of curvature which is larger than a minimum radius of curvature to form a large R portion. That is to say, bending with a large radius of curvature (R) is performed to form a large R portion in a region in which splitting or excessive reduction of plate thickness of the bend outer-side portion, or buckling of the bend inner-side portion, does not occur. Subsequently, in the second process, the pipe is bent with a small radius of curvature form a small R portion by pressing a pipe-end portion of the pipe from a pipe-end direction while fixedly holding the bend side wall of the pipe.

In the second process, the pipe can be bent with an extremely small R with no buckling of the bend inner-side portion by a pressing member or the like to press the pipe-end portion (for example an end surface) from the pipe-end direction in a state where the side wall (which is in a direction perpendicular to the direction of bending) of the pipe is fixedly held so as not to widen.

Additionally, in this case, the bend inner-side portion of the pipe is bent to an angle which is smaller than 90°, and an advantage that the dead space for bending the pipe is eliminated.

Consequently, according to the present invention, an R-minimal elbow configuration can be obtained irrespective of an amount of elongation of the material, and further by minor modification of present equipment.

In this way, the radius of curvature of the small R portion can be less than 1.5 D, thus forming an extremely small R.

When a straight portion of a pipe-end side of the pipe is thrusted into a bend-direction inner side of the small R portion by performing the second process, and a cross-sectional configuration of the thrusted-in portion is set to be a substantially square configuration, and occurrence of buckling and the like can be prevented even when a small R is formed.

That is to say, once the pipe has been formed into the substantially square configuration, extremely large force is required to alter this square configuration, and therefore, deformation which cannot tolerate buckling or the like thereabove is prevented. Thus, it is possible thereby to favorably form an R-minimal elbow portion.

A third process may be performed after the second process to form a pipe-end portion while fixedly holding a bend side wall. The pipe-end portion can be formed so as to be fitted with another pipe with a simple method, without occurrence of buckling or the like.

Further, so-called a bulge may be formed on a pipe-end portion of a pipe into a collar configuration in the third process.

BRIEF DESCRIPTION OF THE DRAWINGS

Additional objects and advantages of the present invention will be more readily apparent from the following detailed description of preferred embodiments thereof when taken together with the accompanying drawings in which;

FIG. 3A is a plan view showing a jig thereof, and FIG. 3B is an explanatory view showing a method for producing in the second bending process by using the jig;

FIG. 7A is an end-face view of a pipe where a first bending has been performed, and FIG. 7B is an end-face view of a pipe where the process has been completed;

FIG. 13A is an explanatory view showing a state of producing thereof from an upper side, FIG. 13B is a cross sectional view showing a state of producing thereof from the front side, and FIG. 13C is an explanatory view showing a state of producing thereof from a side;

FIG. 16A is an explanatory view showing a state where the pipe has been held from an upper side, and FIG. 16B is a partial cross sectional view showing the state where the pipe has been held;

FIG. 17A is an explanatory view showing a state where the pipe has been held from an upper side, and FIG. 17B is a partial cross sectional view showing the state where the pipe has been held;

FIG. 21A is a plan view of a ring-shaped concavity thereof, FIG. 21B is a sectional view of the ring-shaped concavity, and FIG. 21C is an explanatory view showing an enlargement of the ring-shaped concavity;

FIG. 22A is a plan view thereof, and FIG. 22B is a partial cross sectional view thereof;

FIG. 23A is a plan view thereof, and FIG. 23B is a front partial cross sectional view thereof;

FIG. 24A is a plan view thereof, and FIG. 24B is a front partial cross sectional view;

FIG. 25A is a plan view thereof, and FIG. 25B is a front partial cross sectional view;

FIG. 29A is a plan view thereof, and FIG. 29B is a cross sectional view thereof;

FIG. 30A is an explanatory view as seen from a plan view thereof, and FIG. 30B is a partial cross sectional view thereof;

FIG. 31A is a perspective view showing a holding jig thereof, and FIG. 31B is a perspective view showing a state where a joint connector has been mounted on a pipe;

FIG. 32A is a perspective view showing a holding jig thereof, and FIG. 32B is a perspective view showing a state where the joint connector has been mounted on the pipe;

FIG. 33A is a plan view thereof, and FIG. 33B is a cross sectional view thereof;

FIG. 34A is an explanatory view as seen from a top view thereof, and FIG. 34B is a partial cross sectional view thereof.

DETAILED DESCRIPTION OF THE PREFERRED EMBODIMENTS

Preferred embodiments according to the present invention will be described hereinafter in detail with reference to the drawings.

A first embodiment will be described.

Figure 2:
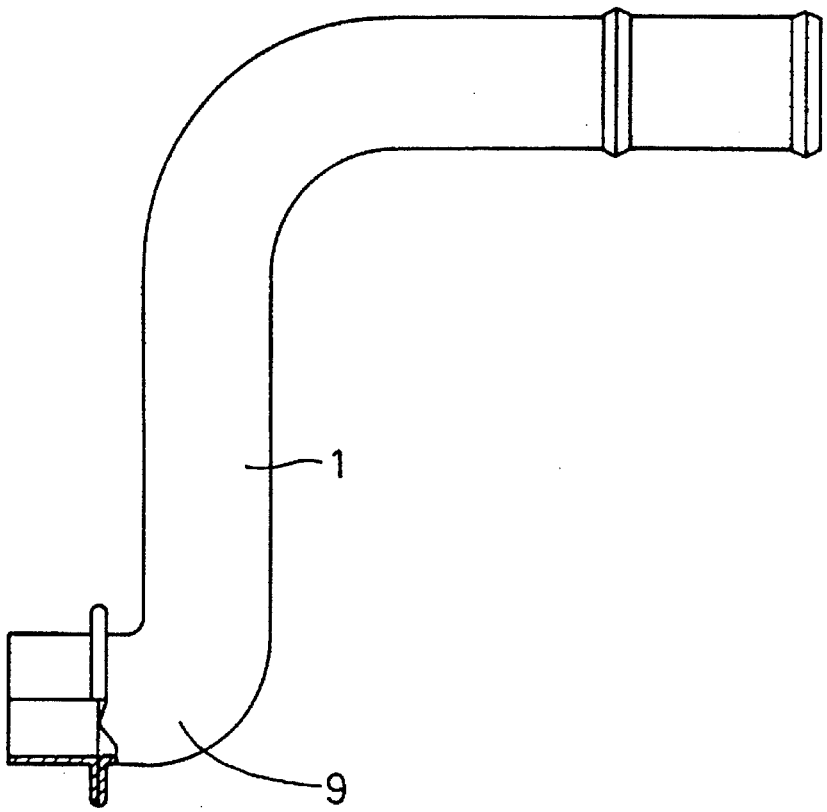
FIG. 2 is a plan view indicating a multiple-bent pipe.

A method for producing a pipe according to the first embodiment produces, with high productivity and low cost, a "part with an elbow portion having a radius of curvature (R) which is small (R<1.5 D, where D is pipe diameter) at a pipe end of a long pipe" as shown in, for example, FIG. 2.

Figure 1A:
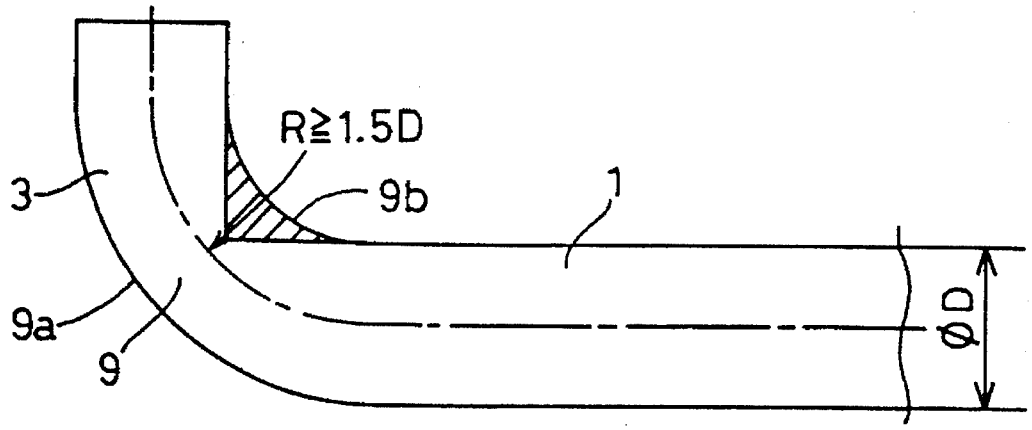
FIGS. 1A–1C are explanatory views sequentially showing a producing processes of a first embodiment according to the present invention.
Figure 1B:
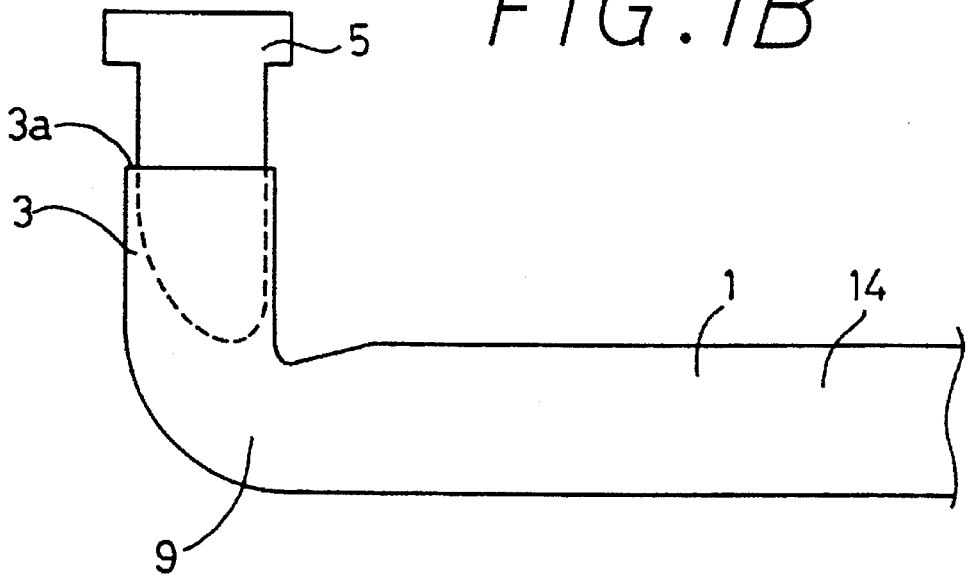
Figure 1C:
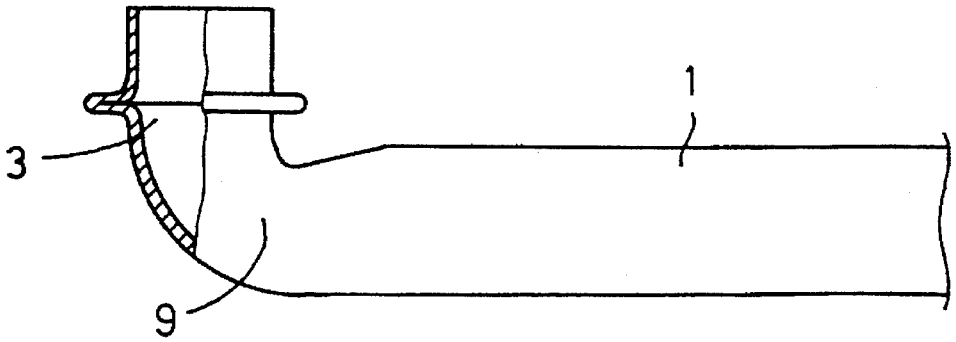

According to the first embodiment, firstly, after a vicinity of a pipe-end portion 3 of a long pipe 1 has been bent at a radius of curvature which is larger than a minimum radius of curvature at which problems such as breakage, buckling, or the like do not occur (first bending in a first process) as shown in FIG. 1A, small-R bending is performed by compressing an end surface 3*a* of the pipe-end portion 3 from a pipe-end direction by a punch 5 as a pressing member (second bending in a second process) as shown in FIG. 1B, and thereafter, the pipe-end portion 3 is formed as shown in FIG. 1C. A method thereof and an apparatus for implementing the same will be described in detail hereinafter.

(1) FIRST PROCESS

Firstly, bending is performed by using an ordinary NC bender or the like with a radius of curvature at which cracking due to plate-thickness reduction of a bend outer-surface portion 9*a* of an elbow portion 9 does not occur and moreover buckling of a bend inner-side portion 9*b* does not occur. Specifically, although minimum radius of curvature varies according to material and plate thickness, in a case of for example material: A3003-0, diameter: 17 mm, and plate thickness: 1.0 mm, a limit bend center R is approximately 1.5 (where D is pipe diameter). Accordingly, a pipe configuration with a large curve as shown in FIG. 1A is formed.

(2) SECOND PROCESS

Figure 3A:
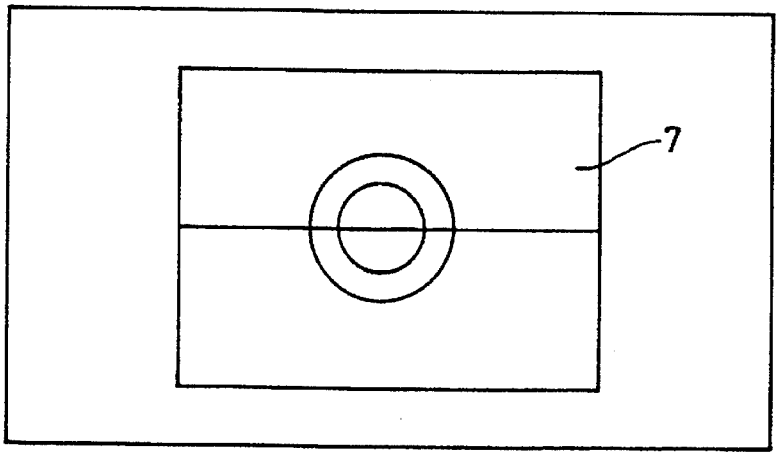
FIGS. 3A and 3B show a second bending process.
Figure 3B:
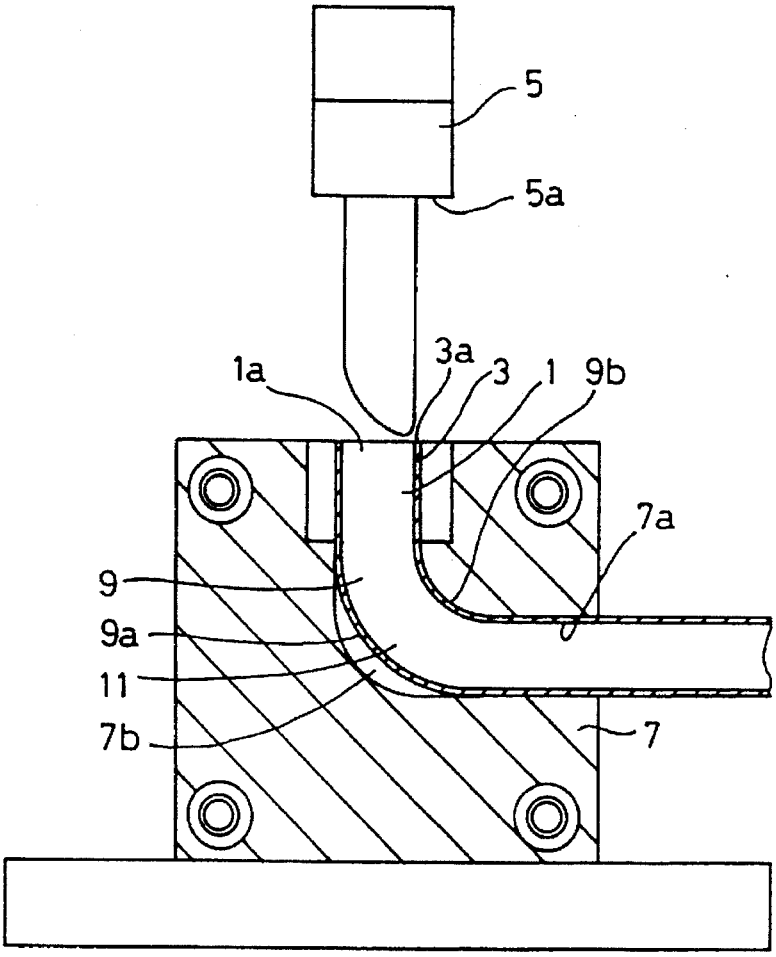

Next, with a laterally separable holding jig 7 as shown in, for example, FIG. 3, the pipe produced by the first bending is fixed in a space 7*a* of substantially L-shaped tubular configuration of an interior of the holding jig 7 by holding each bend side wall 11 of the elbow portion 9, which is formed by the first bending, from an outer side. Consequently, each side portion (corresponding the elbow portion 9) of the space 7*a* of tubular configuration of the holding jig 7 functions as a holding wall (not illustrated). Additionally, at this time, a bending space 7*b* which spreads in an arc-shaped configuration exists on the outer-side portion of the bend outer-side portion 9*a* of the elbow 9.

Next, a punch 5 provided with a mandrel, for compressing an end-surface, is inserted from an open portion 1*a* of the pipe 1 fixed by the holding jig 7, the bend outer-side portion 9*a* of the elbow portion formed by the above-described first bending is depressed while the end surface 3*a* of the pipe-end portion 3 is pressed with a step portion 5*a* of the punch 5, thus performing the second bending (small-R bending). Configuration of a tip side of this punch 5 is set to correspond to that of the bend outer-side portion 9*a* of the pipe 1, and when the punch 5 compresses the pipe-end portion 3, the bend outer-side portion 9*a* is simultaneously pressed so as to widen from an inner-side surface thereof to the above-described bending space 7*b*.

In this way, the pipe configuration shown in FIG. 1B is obtained. That is to say, the bend inner-side portion 9*b* bends so that an angle thereof becomes narrower than 90°, and is shifted downwardly from an upper surface of a length-side straight portion 14 of the pipe 1 which extends horizontally.

(3) THIRD PROCESS

Figure 4:
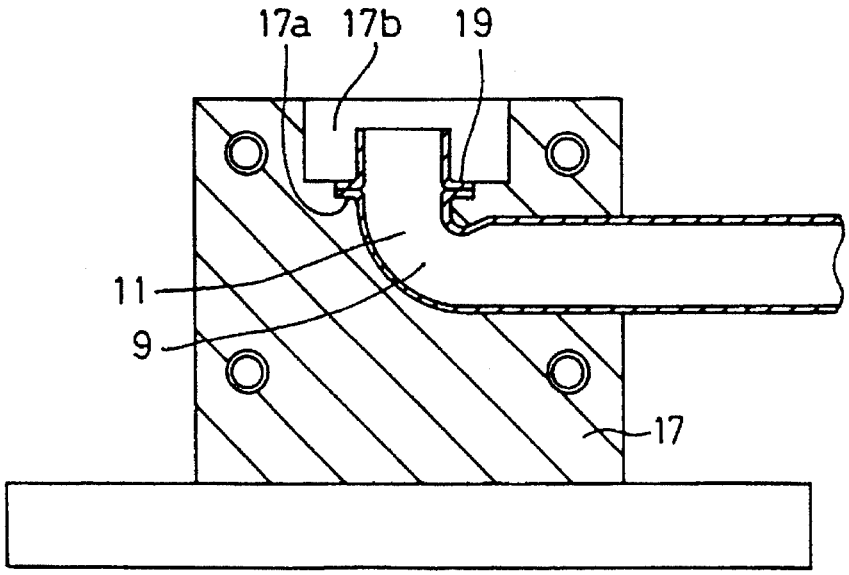
FIG. 4 is an explanatory view showing a pipe fixed in a jig to perform pipe-end bulge forming.

Next, a process for forming the pipe-end portion 3 is performed so that the pipe 1 is fitted into paired pipe. As shown in FIG. 4, in this process, by a holding jig 17 similar to the holding jig 7 shown in FIG. 3, both sides of the bend side wall 11 of the elbow portion 9 formed by the above-described second bending are fixedly held. Moreover, this holding jig 17 differs greatly from the above-described holding jig 7 in having a step 17*a* of annular configuration provided on a portion forming a bulge (collar portion) 19.

Accordingly, the configuration of the desired bulge 19 is obtained by inserting various punches corresponding to the desired configuration to be formed and performing several processes of pipe expansion, drawing, and forming.

Next, this bulge-forming process will be described in detail.

Figure 5C:
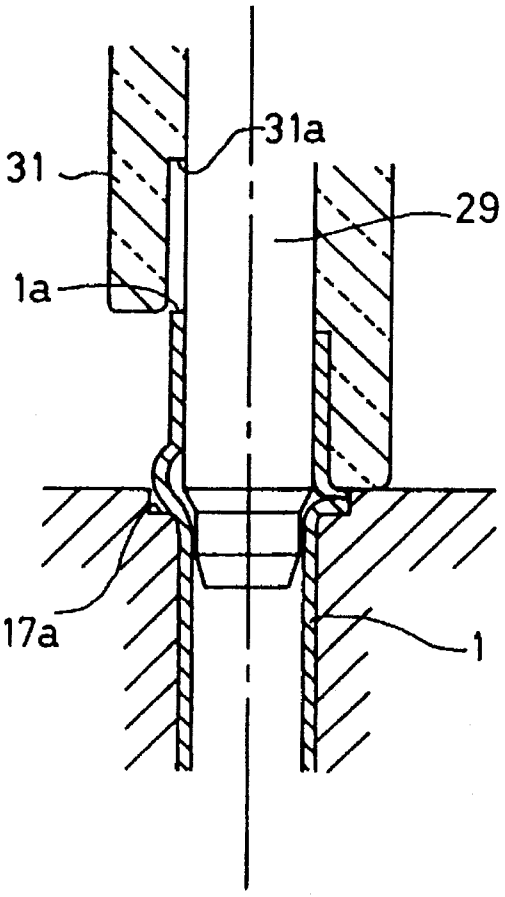
FIGS. 5A–5C are explanatory views sequentially showing processes of the pipe-end bulge forming.
Figure 5B:
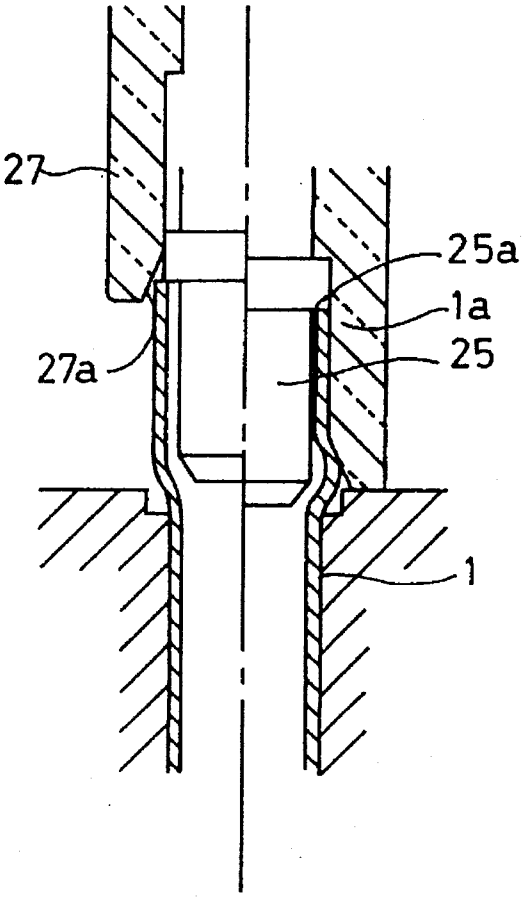
Figure 5A:
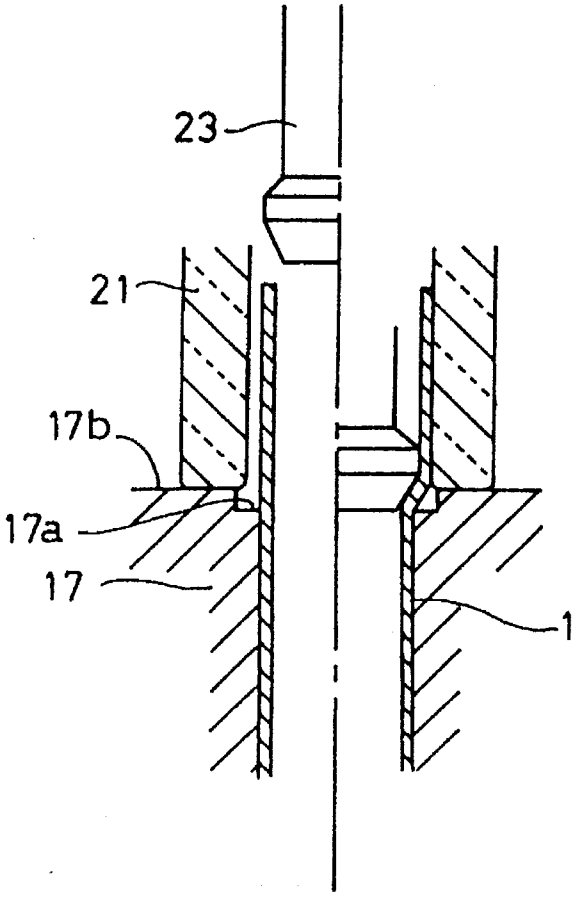

As shown in FIG. 5A, firstly, a first outer punch 21 is externally fitted within a concavity 17*b* of the holding jig 17 so as to form a slight clearance with the pipe 1. Subsequently, a first inner punch 23 of a diameter larger than an inner diameter of the pipe 1 is inserted in an inner side of the pipe 1, and the pipe 1 is widened up to the position of the step 7*a* (pipe widening process).

Next, as shown in FIG. 5B, the end surface 1*a* of the pipe 1 is pressed with a step 25*a* of a second inner punch 25, and along with this, the pipe 1 is drawn by externally fitting a second inner punch 27 having an inner diameter smaller than the inner diameter of the first outer punch 21 with the pipe 1. Then, the pipe 1 is gently bent by an inner side of a tilted surface 27*a* (drawing process).

Next, as shown in FIG. 5C, the end surface 1*a* of the pipe 1 is pressed by a step 31*a* of a third outer punch 31 in a state where a third inner punch 29 has been fitted into the pipe 1, and the pipe 1 is bent by the step 17*a* portion and the bulge 19 is formed.

In this way, according to the present embodiment, a remarkable effect that the inner-side portion 9*b* can be machined with an apparent radius of curvature of zero, i.e., dead space can be eliminated, is obtained at low cost with an extremely simple method of pressing (second process) from the pipe-end direction in a state where the bend side wall 11 of the elbow portion 9 are held by the holding jig 7 after bending (first process) at a radius of curvature which is larger than a minimum radius of curvature. That is to say, according to the present embodiment, a pipe 1 having a minimum-R elbow portion 9 can be produced with stabilized and high productivity.

Additionally, there is an advantage that the bulge 19 can be easily formed on the pipe-end portion 3 without causing buckling, employing various punches in a state where the bend side wall 11 of the elbow portion 9 has been held after the second process.

b) The reason that the pipe 1 having an elbow portion 9 of minimal R can be obtained with stabilized and high productivity according to the present embodiment will be described next.

Figure 6A:
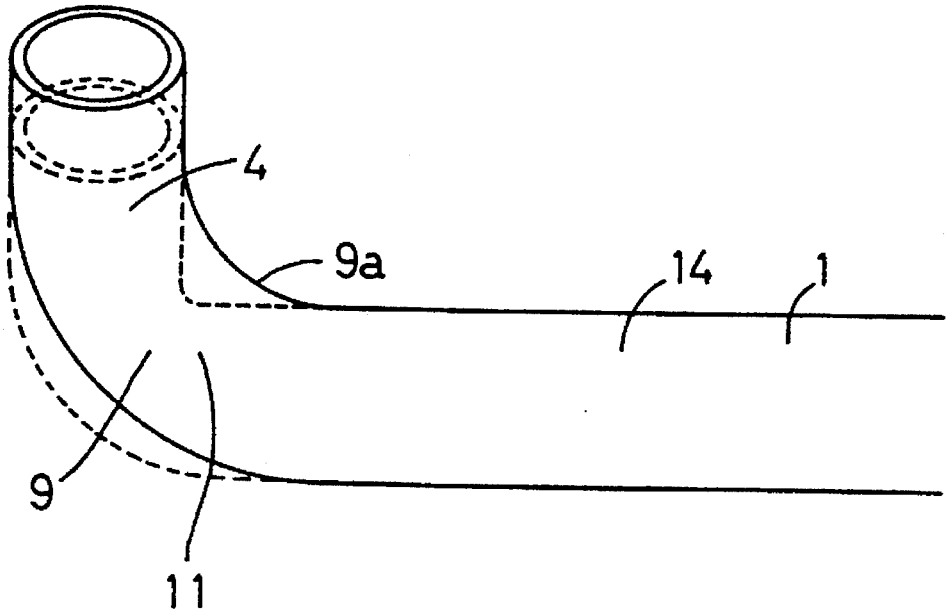
FIGS. 6A and 6B are explanatory views showing a principle of the process in the first embodiment.
Figure 6B:
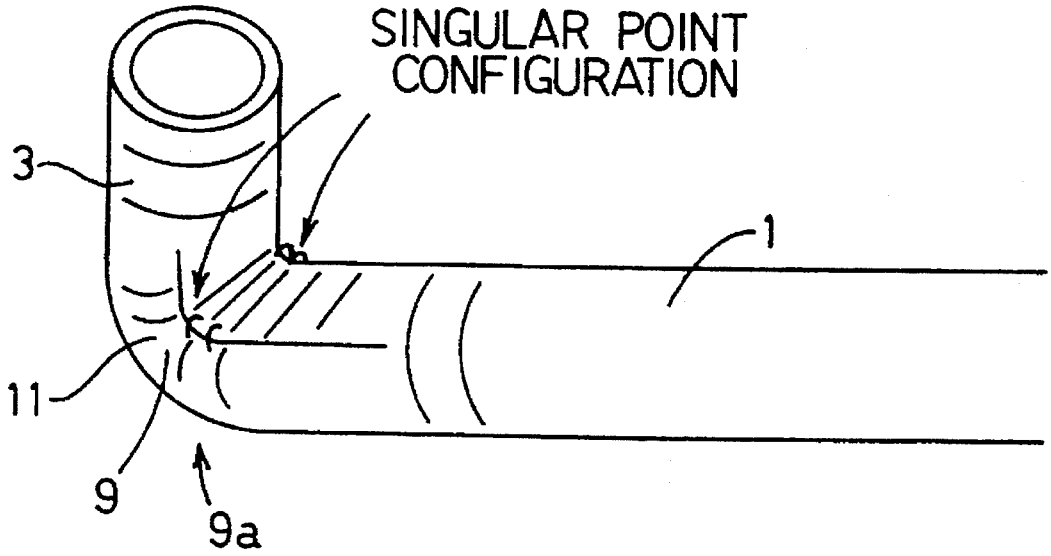

When pressed by the punch 5 after the bend wall surface 11 of the elbow portion 9 obtained in the above-described first bending has been held from the outer side, a pipe-end side straight portion 4 attempts to be thrusted into a portion (bend inner-side portion **9*b*) of right-angle intersection with the length-side straight portion 14, as shown in FIG. 6A. In this way, the bend inner-side portion 9*b* attempts to deform into an elliptical configuration which spreads to the side, however, since the bend side wall 11 is held by the above-described holding jig 7, this portion is tensed with the holding jig 7, and an anglular configuration is formed, as shown in FIG. 6B. Whereas overall shape is formed in a smooth R configuration, this portion is formed in a singular-point configuration. Subsequently to formation of this angular configuration, since a buckling phenomenon whereby the pipe-end side straight portion 4 attempts to be greatly depressed to the inner side of the bend inner-side portion 9*b* can be suppressed, the configuration shown in FIG. 6**B can be stably obtained.

At this time, when the tip portion of the punch 5 presses the inner-side surface of the bend outer-side portion **9*a* of the elbow portion 9 so as to form an R configuration corresponding to the bend outer-side portion 9*a*, a still more favorable configuration is obtained. Herein, a favorable configuration is the one with no excessive variation in the cross-sectional area or the configuration, which does not cause an excessive increase in resistance of a fluid which flows within the pipe 1**.

The process for forming the pipe-end portion 3 will be described. In this case as well, similarly to the above described first bending process, the bend side wall 11 is held and various punches corresponding to the desired configuration to be formed are inserted from the pipe-end portion 3 to thereby obtain the desired configuration. Because the singular-point configuration shown in FIG. 6B is formed in this process as well, this portion gives resistance force to the force for forming the bulge 19 and the like, and buckling to the bend inner-side portion **9*b*** can be prevented.

c) Experimental examples performed to confirm the effect of the method for producing the pipe according to the present embodiment will be described.

Figure 7A:
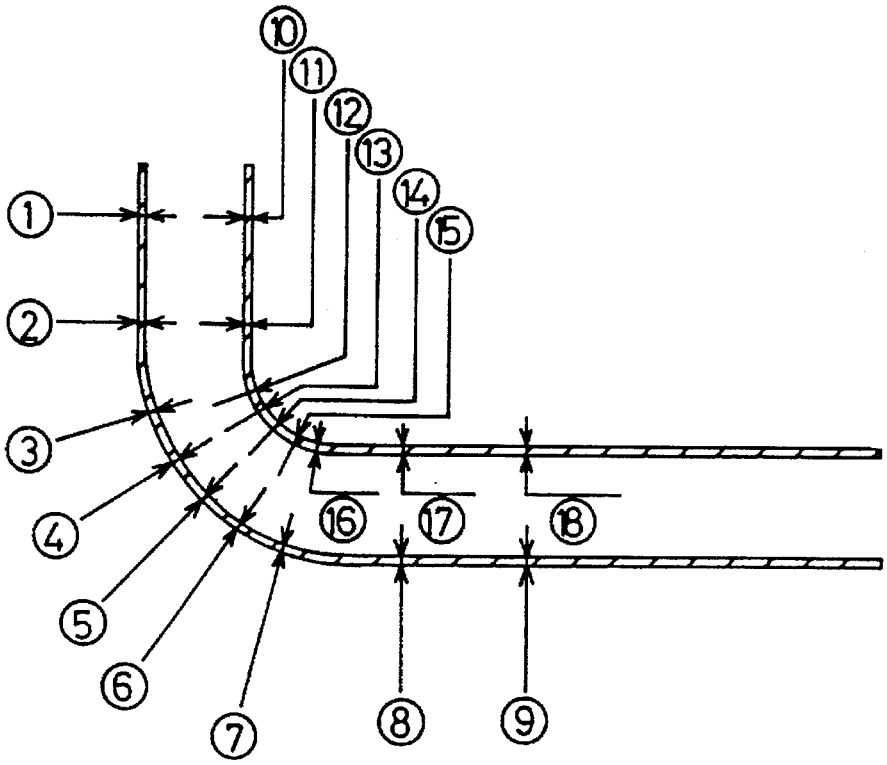
FIGS. 7A and 7B show end surfaces of a pipe.

In this experimentation, firstly, plate-thickness distribution was measured for the pipe 1 for which the first bending had been performed, as shown in FIG. 7A. Measurement was performed at 18 locations along the pipe 1 shown in FIG. 7A. The results thereof are shown in Table 1 below.

TABLE 1

| No. | Outer side (mm) | No. | Inner side (mm) |
|---|---|---|---|
| 1 | 0.968 | 10 | 1.075 |
| 2 | 0.935 | 11 | 1.107 |
| 3 | 0.802 | 12 | 1.241 |
| 4 | 0.715 | 13 | 1.227 |
| 5 | 0.732 | 14 | 1.286 |
| 6 | 0.729 | 15 | 1.252 |
| 7 | 0.731 | 16 | 1.304 |
| 8 | 0.891 | 17 | 1.086 |
| 9 | 0.990 | 18 | 1.016 |

Figure 7B:
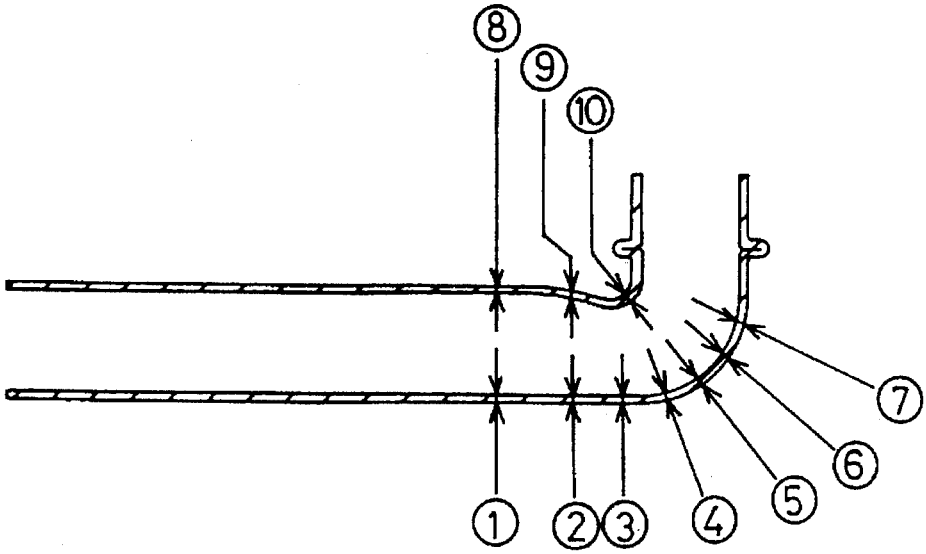
Figure 8:
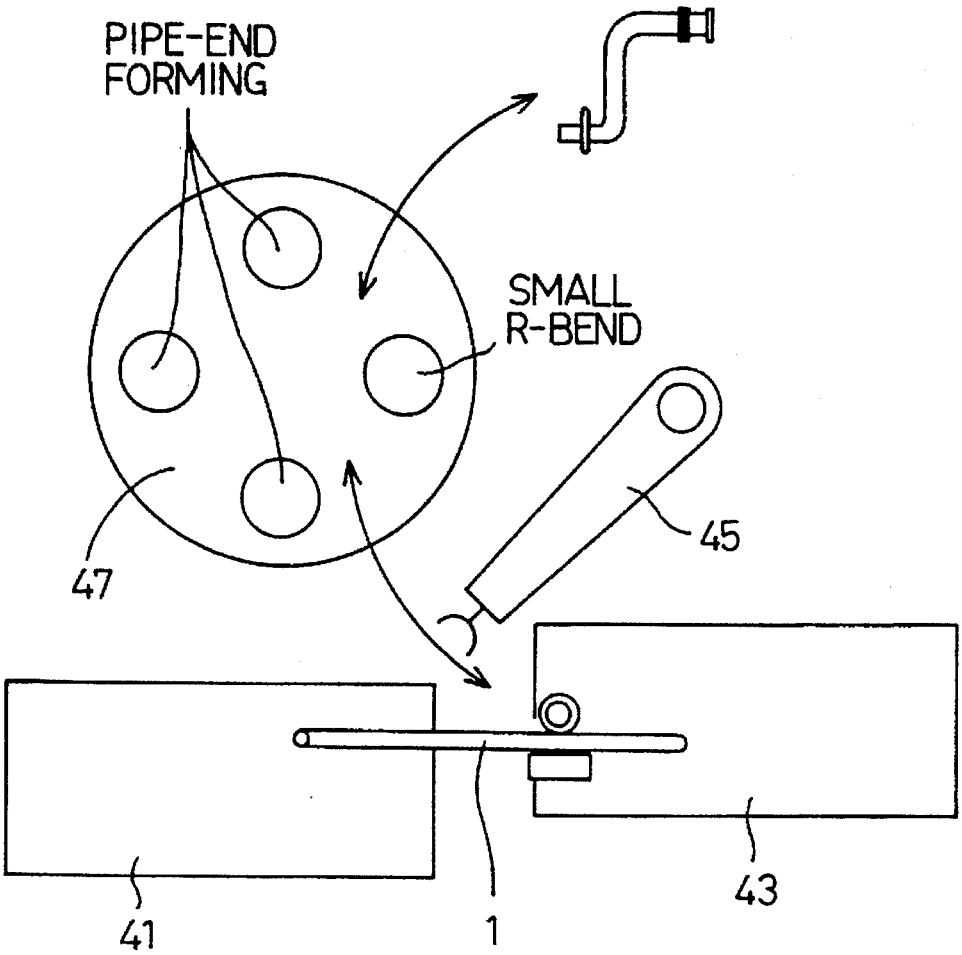
FIG. 8 is an explanatory view showing an apparatus for continuously producing a pipe according to a second embodiment.

Next, plate-thickness distribution was similarly measured for a pipe 18 for which the second bending and pipe-end bulge process had been performed. Measurement was performed at 10 locations along the pipe 1 shown in FIG. 7B. The results thereof are shown in Table 2 below.

TABLE 2

| No. | Outer side (mm) | No. | Inner side (mm) |
|---|---|---|---|
| 1 | 1.027 | 8 | 1.150 |
| 2 | 0.918 | 9 | 1.182 |
| 3 | 0.831 | | — |
| 4 | 0.820 | | — |
| 5 | 0.859 | 10 | 1.356 |
| 6 | 0.789 | | — |
| 7 | 0.764 | | — |

As is clear from this Table 1 and Table 2, it is understood that plate thickness (in the vicinity of the bend outer-side portion **9*a*) secured at approximately 70% or more by the first bending is not diminished by the process thereafter. That is to say, it is understood that, according to the method for producing the pipe of the present embodiment, the apparent R of the bend inner-side portion 9*b*** is made to be zero and the diminution of plate-thickness can be suppressed as compared with the conventional bending process while maintaining stabilized and high productivity.

Next, a second embodiment will be described.

A method for producing a pipe according to the second embodiment performs the processes from (1) THE FIRST PROCESS through (3) THIRD PROCESS of the foregoing first embodiment as a continuous process by a robot or the like.

As shown in FIG. 7, a device for the continuous process firstly performs multiple bending process including a bending which corresponds to the above-described first bending by an NC bender 43 on a pipe 1 supplied by a pipe feeder 41.

Thereafter, the pipe 1 is transferred to a pipe-end machining device 47 by a transfer device 45 such as a robot or the like, and second bending and pipe-end bulge process are performed at the pipe-end machining device 47 by successively inserting punches by a turret system or the like.

In this way, according to this embodiment, the pipe 1 can be produced continuously, and there is an advantage that all processes can be performed merely by adding the first process (i.e., a small-R bending process) to the conventional turret stage for forming a bulge.

Next, a third embodiment will be described.

Figure 9:
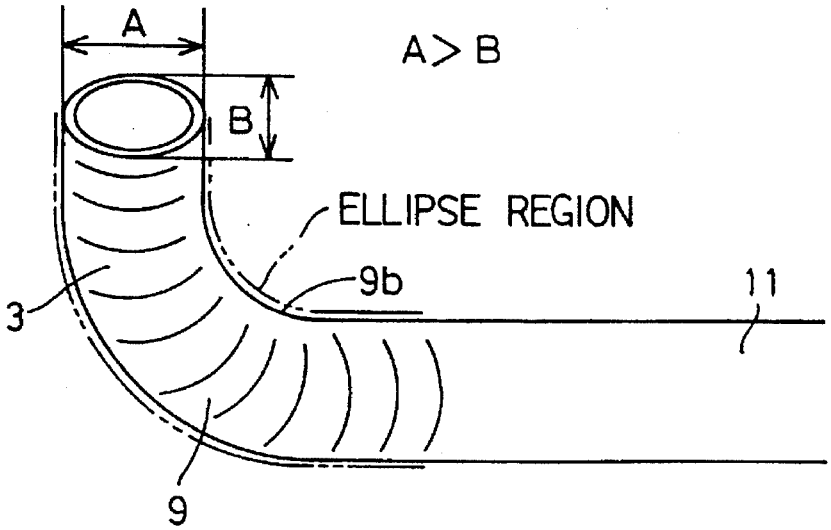
FIG. 9 is an explanatory view showing a producing method according to a third embodiment.

According to the third embodiment, in the first bending of the pipe 1, as shown in FIG. 9, the pipe 1 is formed into an elliptical configuration so that a dimension B in the direction perpendicular to the bend becomes smaller than a dimension A of the direction of bending up to a predetermined range (for example identical length to the left and right with the elbow portion 9 at center) of the pipe-end portion 3 extending to the elbow portion 9. Thereby, rigidity to suppress buckling of the bend inner-side portion **9*b*** is improved and a favorable small-R bend configuration is obtained in the second bending (small-R bending).

Furthermore, according to this embodiment, even when the pipe-end portion 3 is formed into an elliptical configuration in the first bending, the elliptical portion is re-formed to true circularity by inserting a mandrel having a true circularity (and a fitting jig corresponding thereto) at bending of small-R and forming of the pipe-end portion (forming the pipe-end bulge), and so a configuration similar to the first embodiment is obtained.

Next, a fourth embodiment will be described next.

According to the foregoing first embodiment, different holding jig was employed to form the small-R being and the pipe-end portion 3, respectively, however, according to the fourth embodiment, an identical jig is employed. Specifically, the holding jig 17 having the step portion 17*a* utilized to form the pipe-end portion 3 is employed.

Although whether or not the same jig can be employed depends on the forming configuration of the pipe-end portion 3, the same jig can be employed with a bulge configuration as shown in the foregoing first embodiment.

In this way, in a case that the same jig is employed, it is not necessary to transfer the pipe 1 to be produced, and moreover the work efficiency is improved, thus contributing to cost reduction.

A fifth embodiment will be described next.

In the fifth embodiment, the holding jig can be commonly used independently from a forming configuration of a pipe-end portion.

a) Firstly, a jig and the like used in this embodiment will be described.

Figures 10A, 10B, 10C:
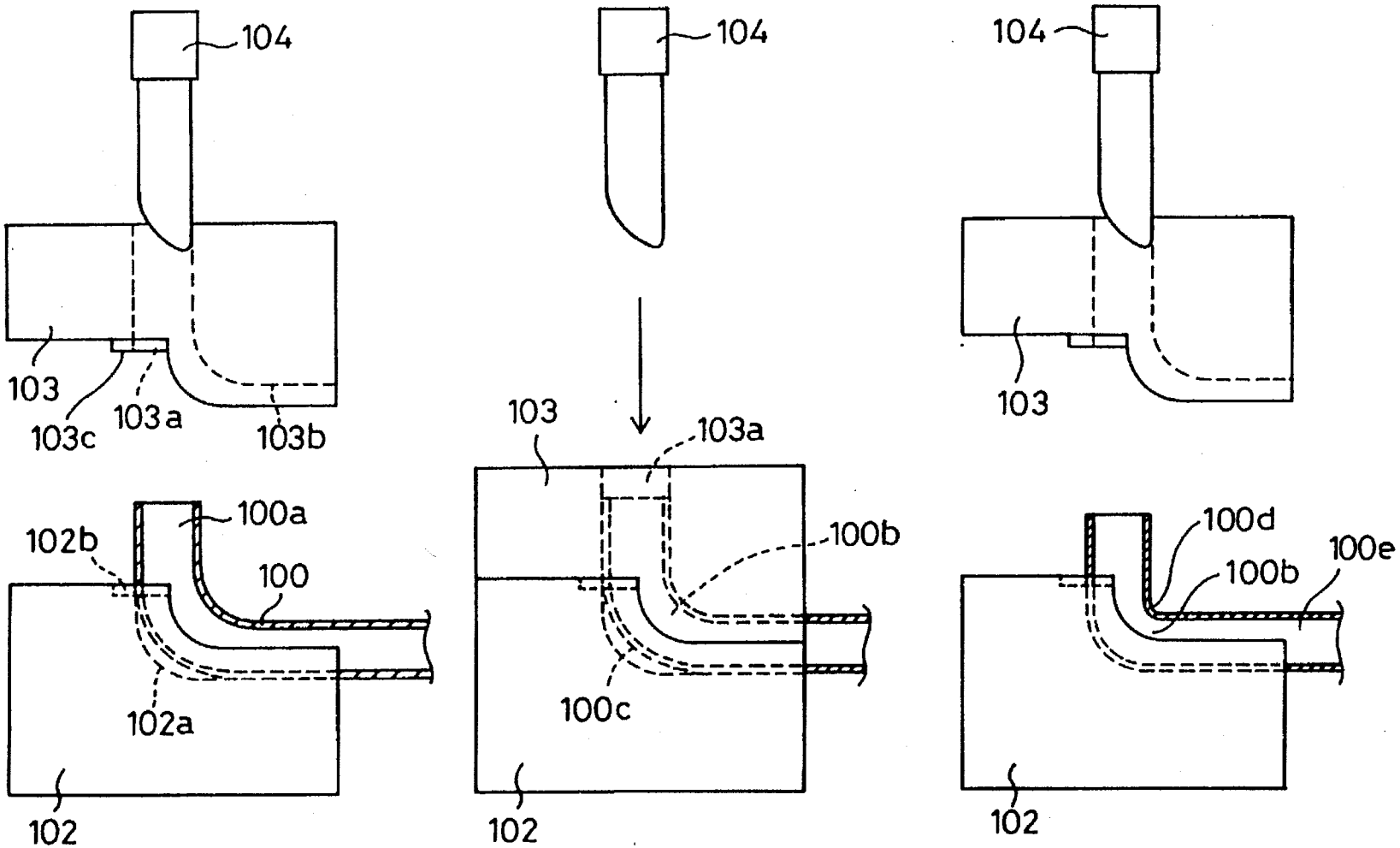
FIGS. 10A–10C are explanatory views sequentially showing a second process of a producing method according to a fifth embodiment.

As shown in FIGS. 10A and 10B, a lower pipe-support portion 102 as a holding jig for fixedly holding a lower half of a pipe 100, an upper pipe-support portion 103 as a sleeve for fixedly holding an upper half of the pipe 100 and a pipe-end portion 100*a*, and punch 104 for pressing a pipe-end surface are employed in a second process to form an elbow portion of a pipe into a small-R configuration.

Additionally, as shown in FIG. 11, the above-described lower pipe-support portion 102 for holding a lower half of the pipe 100, a jig 105 for a bulge to support a collar portion 100*f* of a bulge configuration, and a punch 106 and sleeve 107 for forming the bulge configuration are employed in a third process to form the pipe-end portion 100*a* of the pipe 100.

b) A method for producing a pipe according to this embodiment will be described next.

(1) Firstly, the second process will be described.

As shown in FIG. 10A, a pipe 100 bent similarly as in the first process of the above-described first embodiment is positioned in the lower pipe-support portion 102 as a holding jig.

Figure 12A:
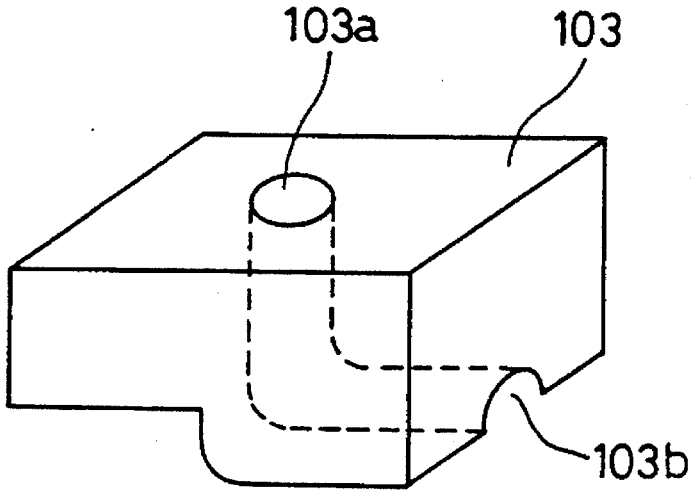
FIGS. 12A and 12B are perspective views showing a holding jig utilized in the producing method according to the fifth embodiment.
Figure 12B:
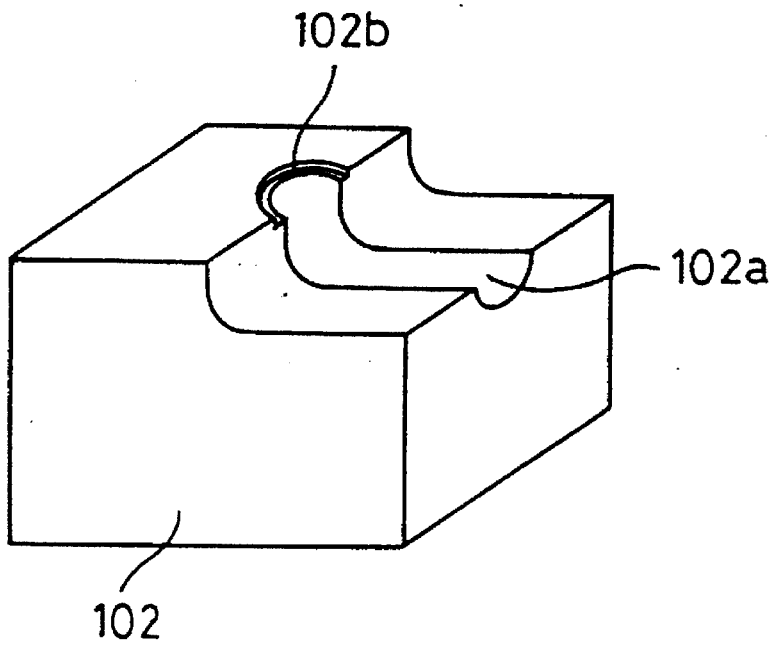

As shown in FIG. 12, the lower pipe-support portion 102 is formed in a configuration so as to cover approximately half of a lateral-projection configuration (L-shaped configuration) of the pipe 100. That is to say, a groove 102*a* into which a lower half (which is a surface on the left-hand side of the drawing) and a lateral half of the pipe 100 fit is formed in the center of a member, a cross-section of which is L-shaped configuration. Further, a notch 102*b* of a half-collar configuration for forming a bulge of a third process is formed in a periphery of an upper end of the groove 102*a*.

(2) Accordingly, as shown in FIG. 10B, the upper pipe-support portion (sleeve) 103 is lowered in a state where the pipe 100 has been disposed in the groove 102*a* of the lower pipe-support portion 102, so as to sandwich the pipe 100 between the upper and lower pipe-support portions 102 and 103, thereby fixing the pipe.

As shown in FIG. 10A, an insertion hole 103*a* into which the pipe-end portion 100*a* of the pipe 100 is inserted (passes through vertically) and a groove 103*b* into which an upper half (which is a surface on the right-hand side of the drawing) and a lateral half of the pipe 100 fit are formed in this upper pipe-support portion 103. Further, a protrusion 103*c* of half-collar configuration corresponding to the above-described notch 102*b* is formed in a periphery of a lower end of the insertion hole 103*a*.

Figure 13A:
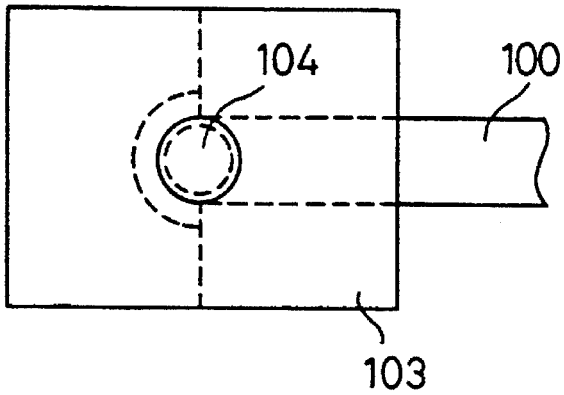
FIGS. 13A–13C show the producing method according to the fifth embodiment.
Figure 13B:
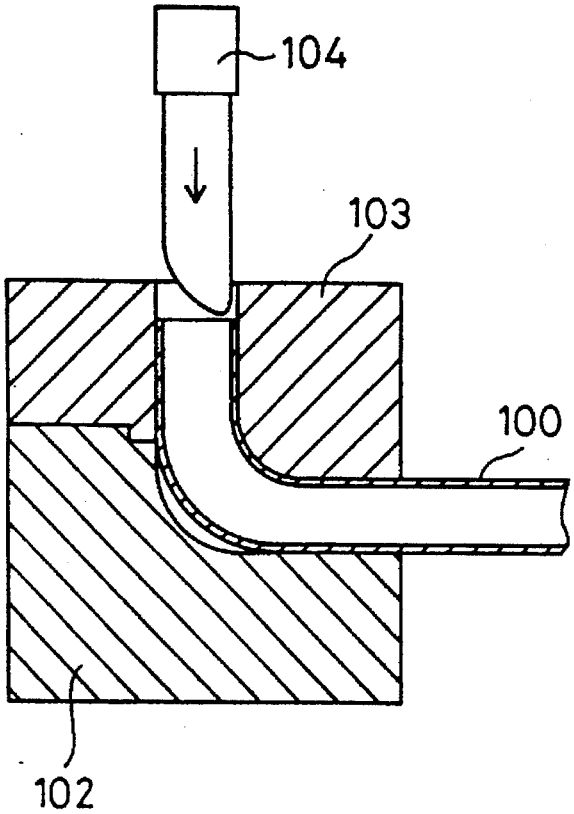
Figure 13C:
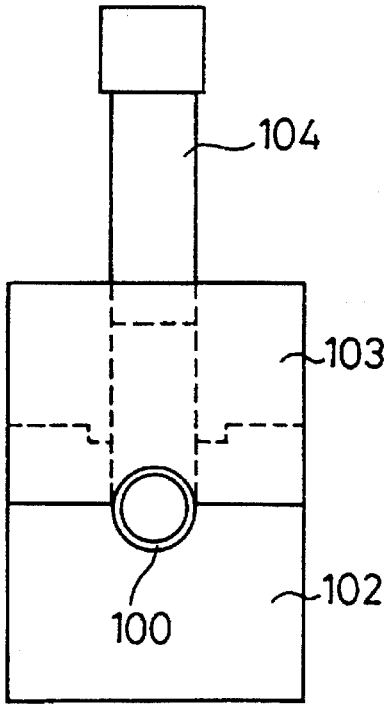

(3) Next, as is shown in FIG. 10A and FIG. 13, the punch 104 is inserted in this state, and small-R bending at a bend outer portion 100*c* of an elbow portion 100*b* is performed similarly to the foregoing first embodiment.

(4) As shown in FIG. 10C, a bend inner portion 100*d* of the elbow portion 100*b* is thereby moved downwardly from an upper surface of a long straight portion 100*e* and is bent into a substantially right-angle configuration. Thereafter, the upper pipe-support portion 103 is moved upwardly. The punch 104 and the upper pipe-supporting portion 103 are raised, when the second process is completed.

(5) The third process will be described next.

Figures 11A, 11B, 11C:
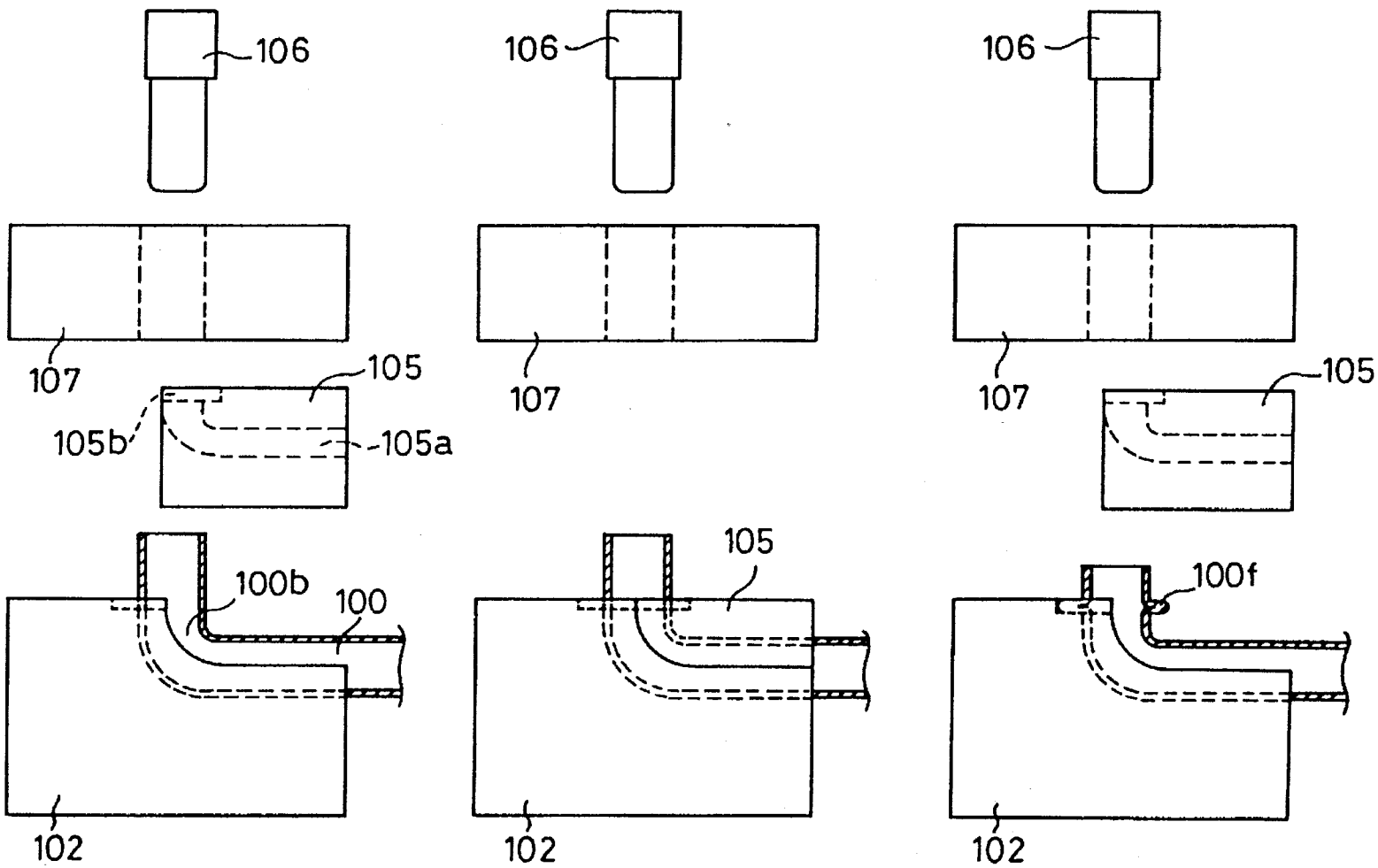
FIGS. 11A–11C are explanatory views sequentially showing a third process of the producing method according to the fifth embodiment.
Figure 14:
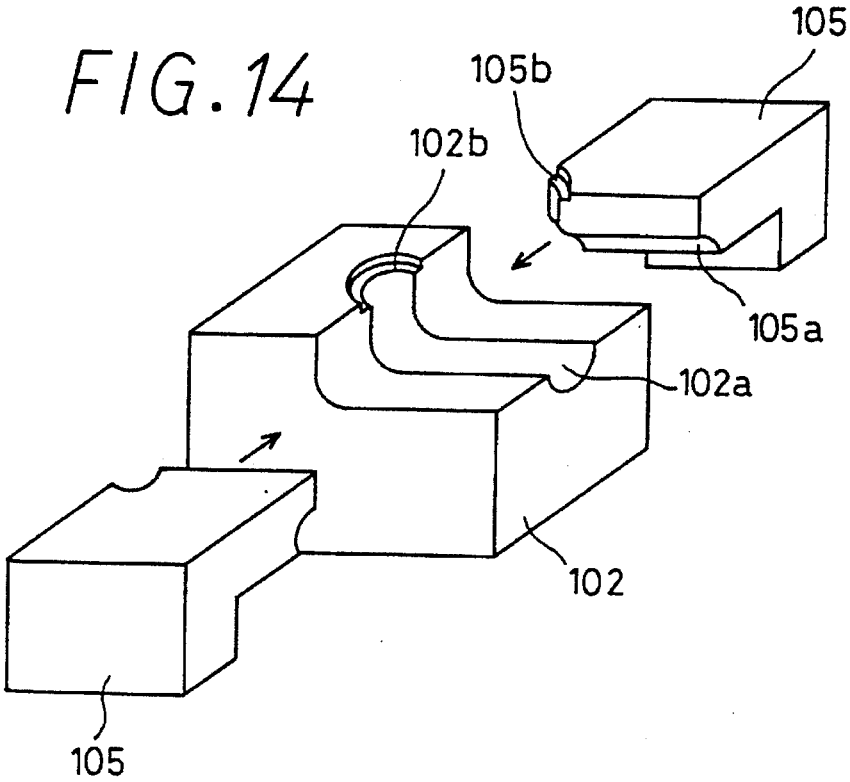
FIG. 14 is a perspective view showing a jig for forming bulge and the like utilized in the producing method according to the fifth embodiment.

With the pipe 100 having the elbow portion 100*b* formed in a small R in the foregoing second process is set in the lower pipe-support portion 102 as shown in FIG. 11A, the jig 105 for forming a bulge is set so as to be sealed to the lower pipe-support portion 102, as shown in FIG. 11B. According to this embodiment, the jig 105 for the bulge is halved into two laterally symmetrical pieces, as is shown in FIG. 14, and has a groove 105*a* of substantially "<"-shaped configuration corresponding to the bend configuration of the pipe 100 and a notch 105*b* of half-collar configuration. In FIG. 14, a method for setting the jig 105 by sliding from a side is shown.

(6) A state similar to the third process of the first embodiment is thereby obtained. When the sleeve 107 and punch 106 are lowered and bulge forming similar to the first embodiment is performed, the desired bulge configuration can be obtained.

(7) Finally, the sleeve 107 and punch 106 are raised, and the jig 105 for forming the bulge is detached from the lower pipe-support portion 102. The state is shown in FIG. 11C, when the third process is completed.

As described above, when the structure in this embodiment is employed, the same holding jig (lower pipe-support portion 102) can be employed in the second process and third process independently from a formed configuration of a pipe-end portion.

Accordingly, in a case where the same holding jig is employed in the same manner as the present embodiment, it is not necessary to exchange the pipe 100 to be produced, and the desired configuration is obtained solely by sliding the jig 105 for forming the bulge and continuously inserting the punches 104 and 106, thus further contributing to cost reduction.

Furthermore, as far as the above described jig 105 for forming the bulge can be set in the lower pipe-support portion 102, a similar effect is obtained even when the jig 105 is integrally formed or separated into several pieces.

A fifth embodiment will be described next.

Figure 15:
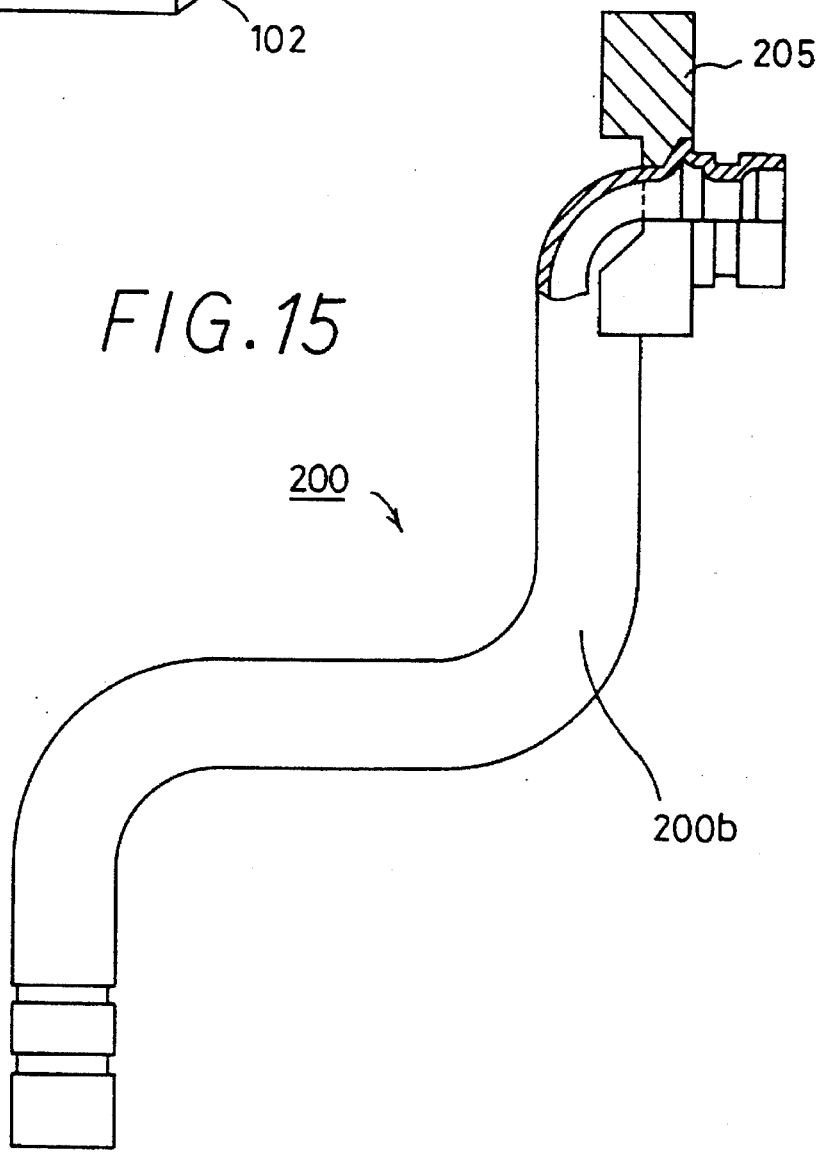
FIG. 15 is a partial cross sectional front view indicating a pipe according to a sixth embodiment.

As shown in FIG. 15, the fifth embodiment relates to a method for forming a pipe 200 having a joint connector 205 which is employed in cooler piping or the like to improve the fastening force.

a) Firstly, a jig and the like used in the present embodiment will be described.

Figure 16A:
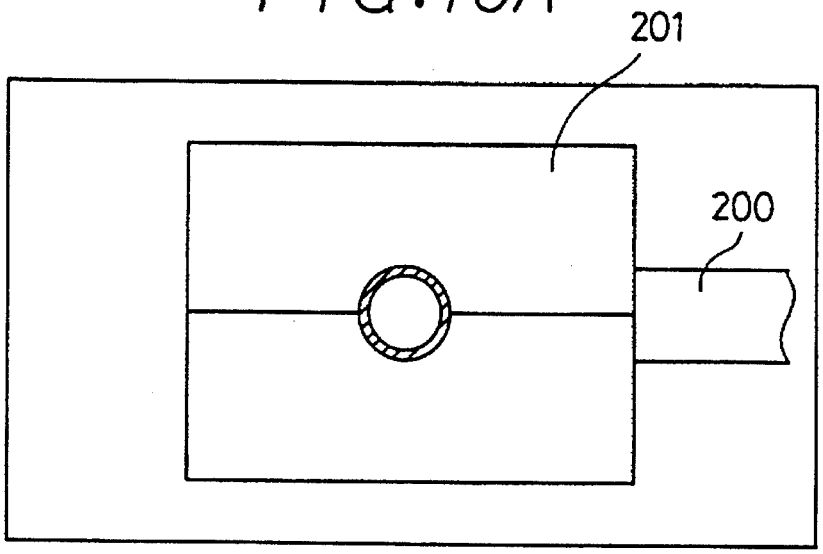
FIGS. 16A and 16B show a second process of a producing method according to the sixth embodiment.
Figure 16B:
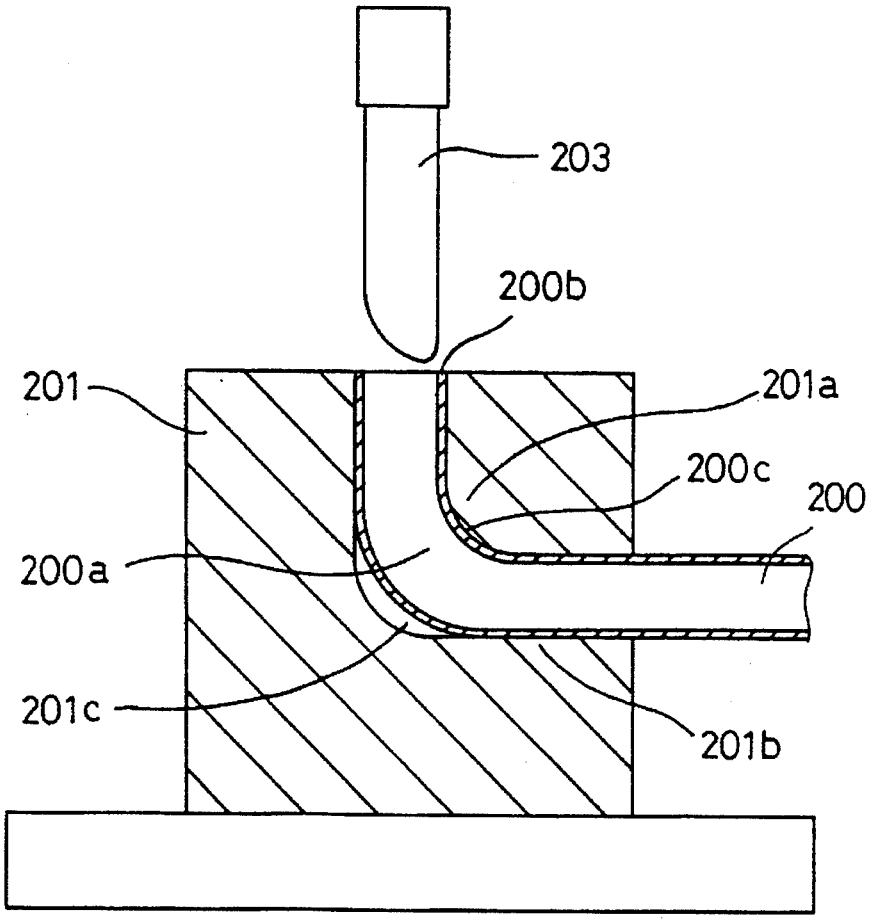

As shown in FIG. 16, a holding jig 201 provided with a through-hole 201*c* of a substantially "<"-shaped configuration and a punch 203 for pressing a pipe-end portion are employed in a second process to form an elbow portion 200*a* of a pipe 200 into a small-R configuration. Further, the holding jig 201 has a portion 201*a* for fixedly holding a bend side wall of the pipe 200 and a portion 201*b* for supporting the pipe 200 so as to face the through-hole 201*c*.

Figure 17A:
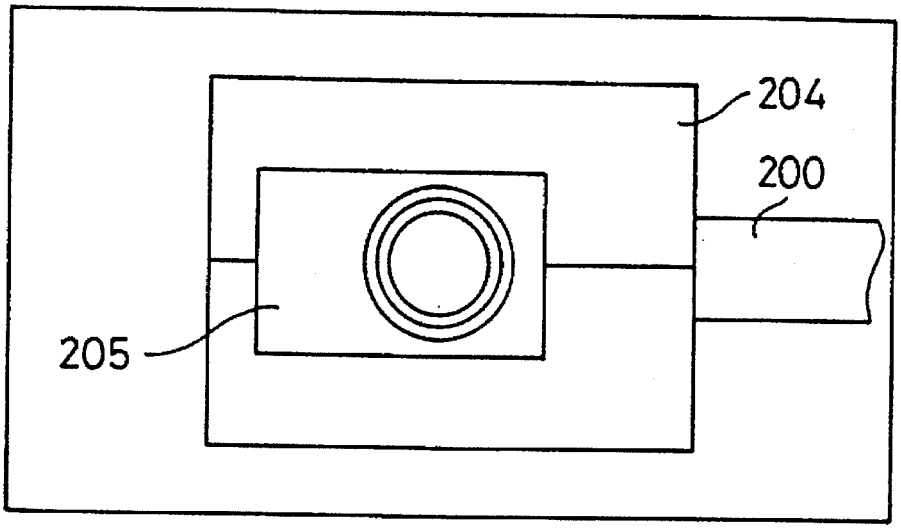
FIGS. 17A and 17B indicate a third process of a producing method according to the sixth embodiment.
Figure 17B:
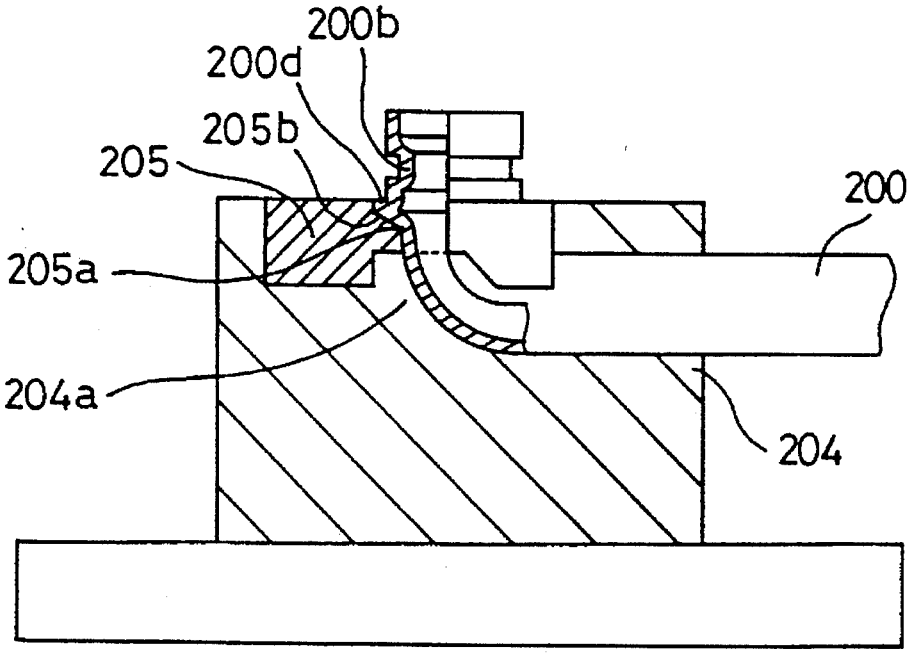

Additionally, as shown in FIG. 17, a support jig 204 having a portion 204*a* for supporting the pipe 200 and punches 206, 207, and 208 (see FIG. 18) for engaging the pipe 200 with the joint connector 205 are employed in a third process to form the pipe-end portion 200*b* of the pipe 200 in a state where the joint connector 205 adapt to be engaged with another pipe has been inserted. The punches 206, 207 and 208 are employed similarly to the first embodiment.

b) A method of pipe machining according to this embodiment will be described next.

(1) The second process will be described firstly.

The second process is basically similar to the first embodiment; in a state where the pipe 200 is fixedly held by the (laterally separating) holding jig 201 so that a side surface of the pipe 200 is not widened, the punch 203 is employed to press a pipe-end portion (for example an end surface) from a pipe-end direction of the pipe 200. The pipe 200 can thereby be bent to a small R with no buckling of a bend inner-side portion 200*c*.

(2) Next, the third process will be described with reference to FIGS. 17 and 18.

Figure 18C:
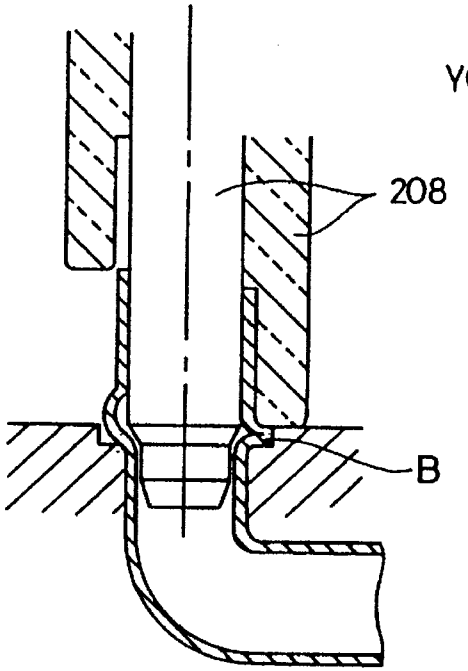
FIGS. 18A–18C are explanatory views sequentially showing a method for forming a bulge according to the sixth embodiment.
Figure 18B:
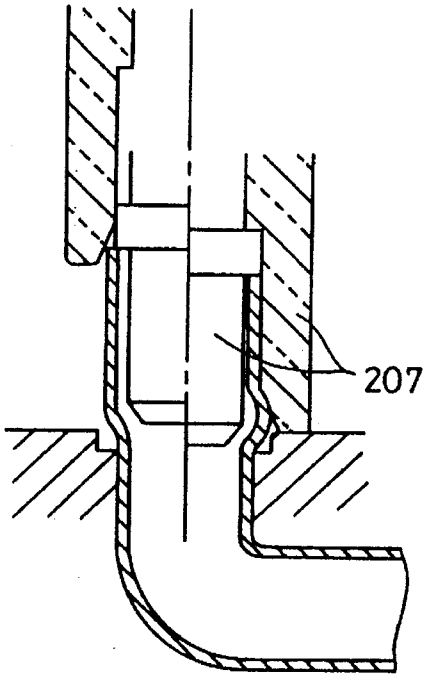
Figure 18A:
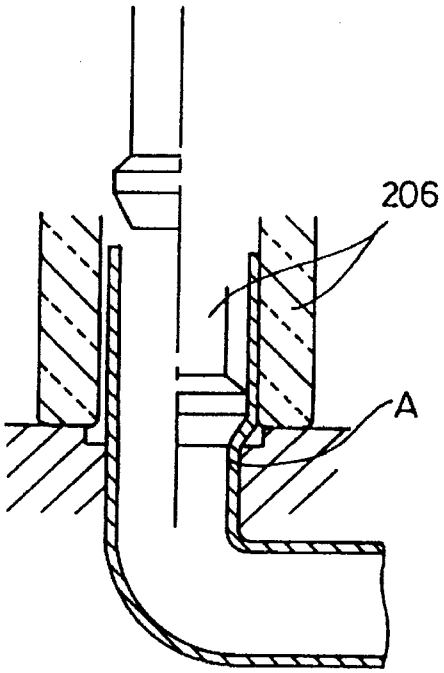

As shown in FIG. 17, a desired fitting configuration is obtained by sequentially and continuously lowering and pressing the punches 206, 207 and 208 as shown in FIG. 18 to the pipe 200 in a state where the joint connector 205 has been fitted into the pipe-end portion 200*b* of the pipe 200 bent into a small-R configuration in the foregoing second process. Additionally, a notch 205*b* for forming a bulge 200*d* is provided in a periphery of an upper end of the through-hole 205*a* of the joint connector 205.

Furthermore, side-wall of the pipe 200 in this process can be fixedly held by using the support jig 204 or the connector 205. Additionally, joining of the pipe 200 and connector 205 can be performed at area A by the punch 206 or by pipe-widening force of the collar portion (area B) by another punch 208.

Thus, according to this embodiment, the pipe-end portion 200*b* can be formed by a simple procedure, and the joint connector 205 for improving the fastening force with the fitting member can be fitted in the proximity of the pipe end of the pipe 200 bent to a small-R configuration. In this case, by linking the connector 205 and the fitting member by bolts or the like, an effect that the fastening force is greatly improved as compared with a case where a pipe alone is connected to a fitting member is obtained.

This method for forming the bulge is preferably applied to the pipe having an obliquely irregular pipe-end portion, or an excess-pad portion which may be caused when the straight pipe has been bent. The effect will be described next.

Figure 19:
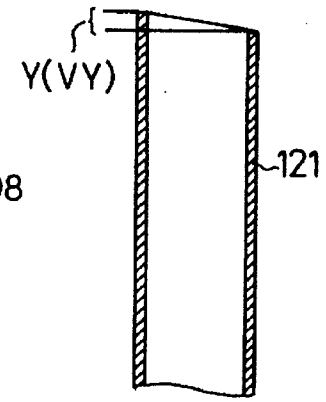
FIG. 19 is a sectional view showing a pipe having an obliquely irregular pipe-end portion.

That is to say, as shown in FIG. 19, the obliquely irregular pipe-end portion is provided (so as to protrude to the left-hand side of the drawing) at an of a pipe 121, and bulge forming is performed so as to absorb such oblique excess-pad portion Y into a flange 123 (see FIG. 22). An embodiment where a pipe-end portion is oblique will be described.

1. Fixing Process

Figure 20A:
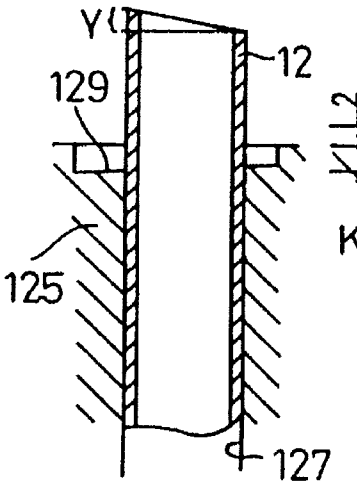
FIGS. 20A–20D are explanatory views sequentially showing processes of a method for forming the bulge.

As shown in FIG. 20A, the pipe 121 having an obliquely irregular pipe-end portion is positioned within a hole-shaped support portion 127 (of a configuration identical to the pipe 1) disposed within a first jig 125, and is fixed so as not to be shifted axially or in a direction of rotation.

Figure 21A:
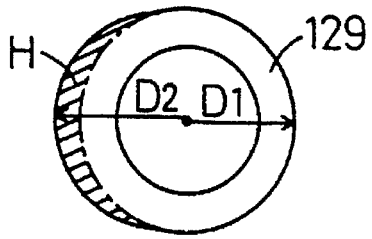
FIGS. 21A–21C show a first jig.
Figure 21B:
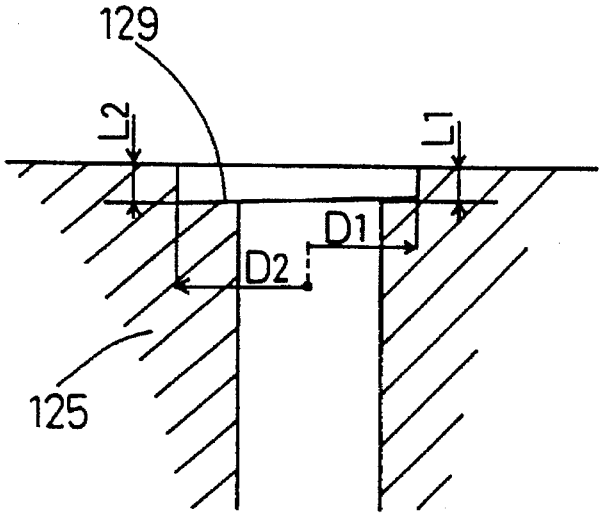

As shown in FIG. 21, this first jig 125 is provided with a ring-shaped concavity 129 corresponding to the configuration of the flange 123 to be formed, and configuration thereof differs greatly from the circular ring of uniform thickness in the conventional type. That is to say, the ring-shaped concavity 129 of the first jig 125 is such that a portion H which is semicircular rather than circular (the slanted-line portion of FIG. 21A) protrudes at a side (the left-hand side of FIG. 19 and FIG. 21) on which the excess-pad portion Y has been formed so that radial dimension D1<D2 is established, and a depth L2 of the left-hand side of FIG. 21B is set to be a value larger than a depth L1 of the right-hand side (L1<L2). Further, a bottom surface of the ring-shaped concavity 129 slopes gently and drops from the right-hand side to the left-hand side by an amount corresponding to a difference in depth thereof.

Figure 21C:
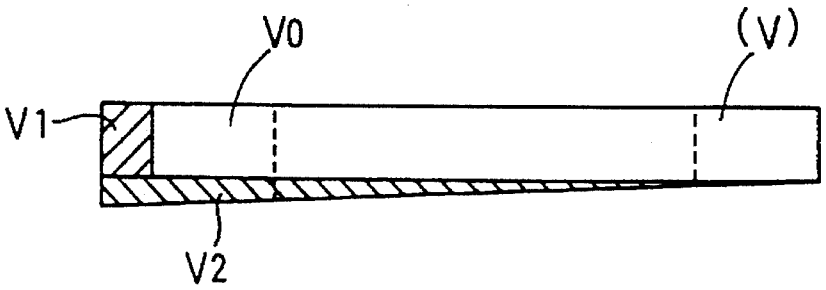

Consequently, as shown in the enlarged view in FIG. 21C, a volume V of the ring-shaped concavity 129 in this embodiment is set to be a total of volume V0 of an ordinary circular ring portion of uniform thickness in the conventional type and volume V2 corresponding to a difference in depth with volume V1 of the semicircular portion H. That is to say, V1+V2, which is the amount of increase in this volume, is set to be equal to the volume VY of the excess-pad portion Y. This is substantially identical to the volume of the flange 123 formed by the ring-shaped concavity 129, as will be described later.

2. Pipe Widening Process

Figure 20B:
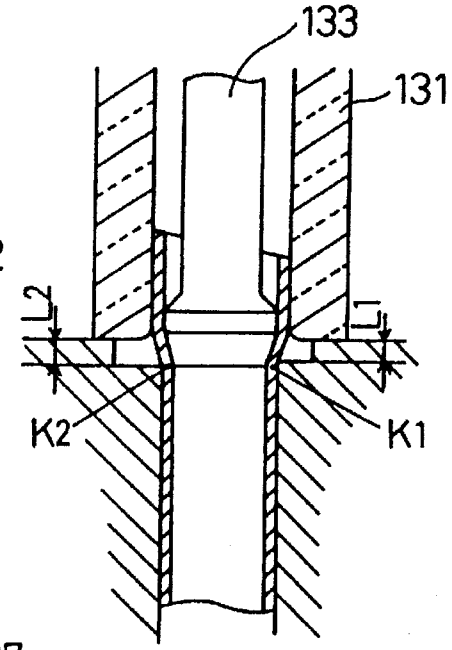

Next, as shown in FIG. 20B, a second jig 131 having an inner diameter larger than the inner diameter of the first jig 125 is externally fitted to the pipe 121 protruding above the first jig 125. Accordingly, the pipe-end portion is cut from the pipe-end side of the pipe 121, a third jig 133 of a tapered-rod configuration is press-fitted, and pipe-widening of the pipe is performed, and squaring of the lower side of the flange 123 is performed. The portion where this squaring is performed is a portion (for example points K1 and K2) of a step of the hole-shaped support portion 127 in the ring-shaped concavity 129.

3. Drawing Process

Figure 20C:
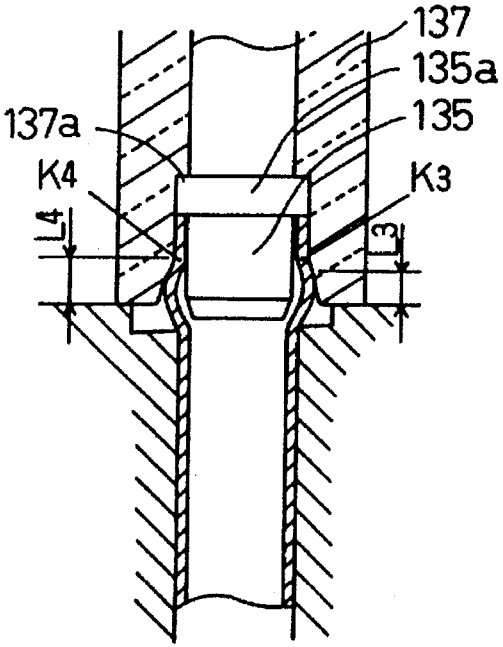

Next, as shown in FIG. 20C, the second jig 131 and third jig 133 are removed, and a fourth jig 135 of a rod configuration having a ring-shaped convexity 135*a* is inserted from the pipe-end side of the pipe 121. An outer diameter of this convexity 135*a* is set to be slightly smaller than the inner diameter of the second jig 131.

In this state, a fifth jig 137 of tubular configuration is externally fitted with the pipe 121. A step (an inner diameter thereof being identical with the outer diameter of the convexity) 137*a* of annular configuration is formed on an inner peripheral surface of the fifth jig 137 so as to be able to press an upper surface of the convexity 135*a*. Additionally, a tip side of the inner peripheral surface of the fifth jig 137 is cut obliquely in a tapered configuration, and this cut portion is formed such that height L4 of the left-hand side in the drawing is greater than height L3 of the right-hand side (L3<L4).

Consequently, by downwardly pressing the fifth jig 137 of the outer side in such a manner that the step 137*a* contacts with the upper surface of the convexity 135*a*, the fourth jig 135 of the inner side is pressed, and the end portion of the pipe 121 is thereby pressed. In this way, the pipe 121 is pressed and bent and squaring of the upper side of the flange 123 is performed. The portion where this squaring is performed is an upper portion (for example points K3 and K4) of the foregoing cut portion.

In this embodiment, diameter of the pipe 121 at the upper side (in the drawing) of the portion where the flange 123 is formed is drawn so as to be larger than the diameter of the pipe 121 of the lower side, however, can be drawn so as to be the same diameter. Moreover, when the pipe 121 at the upper side is drawn in such a manner that diameter thereof is smaller than that of the pipe 121 at the lower side, it is not necessary to perform the above described pipe widening process.

4. Forming Process

Figure 20D:
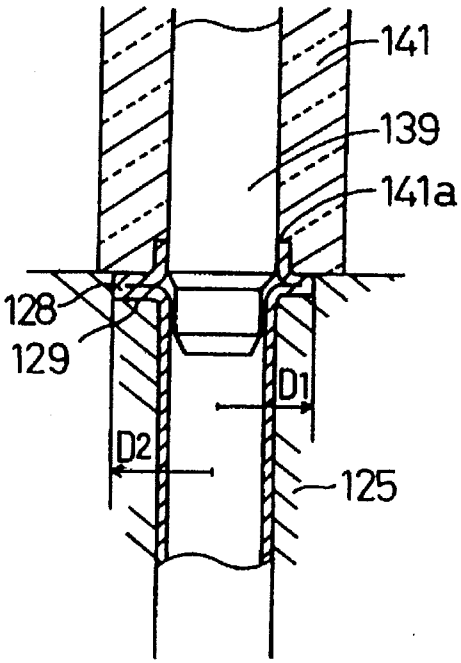

Next, as shown in FIG. 20D, the fourth jig 135 and fifth jig 137 are removed, and a sixth jig 139 of a rod configuration is inserted from the pipe-end side of the pipe 121. Further, this sixth jig 139 is includes a tip-side small-diameter portion and a distal-side large-diameter portion.

In this state, a seventh jig 141 of tubular configuration having a step 141 on an inner peripheral-surface side is externally fitted with the pipe 121, and the upper-end surface of the pipe 121 is downwardly pressed in the step 141*a*. The upper-end portion of the pipe 121 is thereby gradually bent and pressed into the ring-shaped concavity 129 of the first jig 125, and the flange 123 is formed.

The pipe 121 where the flange 123 is formed by the bulge forming is shown in FIG. 21, and the configuration of the flange 123 is substantially similar to the configuration of the ring-shaped concavity 129 of the above-described first jig 125.

Figure 22A:
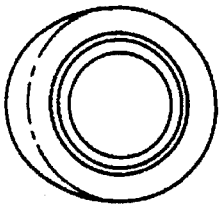
FIGS. 22A and 22B show an end portion of the pipe according to the first embodiment.
Figure 22B:
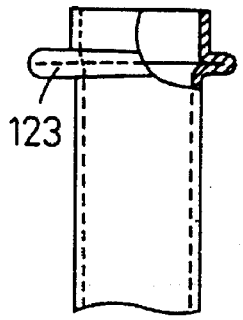

Namely, as compared with a circular flange of uniform thickness in the conventional type, the flange 123 is formed in this embodiment such that the right-hand side of FIG. 22A protrudes in a semicircular configuration, and thickness of the left-hand side of FIG. 22B is thicker than the right-hand side.

That is to say, in this embodiment, when performing bulge forming for the pipe 121 having an irregular pipe-end portion, the configuration (i.e., radial dimension and thickness of the excess-pad portion Y side) of the ring-shaped concavity 129 of the first jig 125 is determined in advance so that volume VY corresponding to the excess-pad portion Y thereof is absorbed into the configuration of the flange 123.

Consequently, the excess-pad portion Y is absorbed as a variation in configuration in the radial direction and direction of thickness of the flange 123 by actually pressing the pipe-end portion of the pipe 121 and performing bulge forming, and the thickness of the pipe-end portion (the portion on the upper side of the flange 123 in FIG. 22B) can be uniform.

Additionally, in this embodiment, the several dimensions L1, L2, L3, L4, D1, and D2 is appropriately determined in a range that the volume VY of the excess-pad portion Y can be absorbed into the deforming portion (from the circular ring of uniform thickness) of the flange 123.

A modification will be described next.

A method for forming a pipe in this modification relates to a method for forming bulge on a pipe having an irregular excess-pad portion at pipe-end portion.

Generally, when a straight pipe has been bent, there exists a difference in length between inner-diameter side and outer-diameter side thereof, and an irregular excess-pad portion occurs on a pipe-end portion.

Figure 23A:
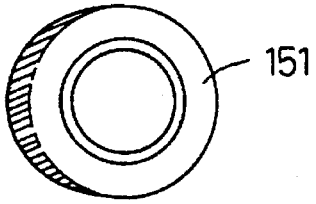
FIGS. 23A and 23B show an end portion of a pipe according to a modification.
Figure 23B:
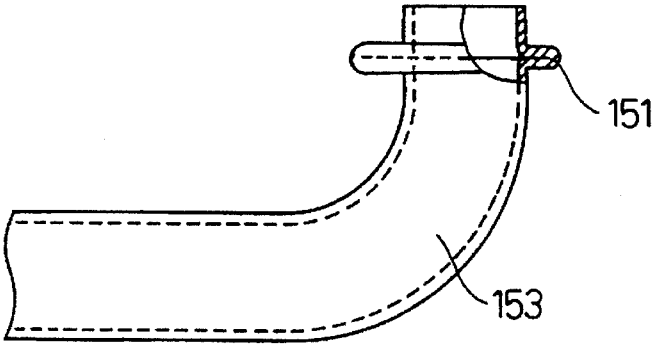

In this modification, as shown in FIG. 23, by a method for forming a bulge, a flange 151 is formed on an irregular pipe-end portion which may be caused in a process where a curved pipe has been formed, and this method is substantially identical to the above described embodiment.

In this modification, the diameter of the pipe 153 at the upper side is substantially identical to that at the lower side (in the drawing) of the flange 151 without any change, even after bulge forming.

Consequently, according to this modification, the irregular excess-pad portion of the pipe-end portion can be absorbed at a time of bulge forming by an increase (the slanted-line portion of the drawing) in the radial dimension and an increase in thickness at the side of the excess-pad portion of the flange 151, similarly to the above embodiment, and the thickness of the pipe-end portion (the portion of the upper side of the flange 151) can be uniform.

Further, sequences and the like other than described above are identical to the above embodiment, and the description thereof will be omitted.

Another modification will be described next.

A method for producing a pipe in this modification relates to a method similar to the above modification, but the configuration of the flange differs slightly.

Figure 24A:
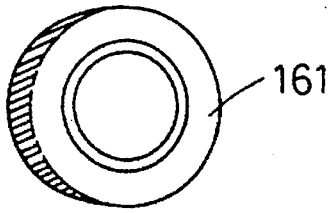
FIGS. 24A and 24B show an end portion of a pipe according to another modification.

As shown in FIG. 24, a flange 41 formed by a method in this modification has an uniform thickness, but only a radial dimension (the slanted-line portion in the drawing) at the side of an excess-pad portion is increased. That is to say, the excess-pad portion can be absorbed into the flange configuration by a first jig (not illustrated) having a hole-shaped support portion corresponding to this flange configuration.

In this modification, in particular, the thickness of the flange 161 is uniformly formed, and the length from a pipe end to a lower surface of the flange 161 is identical over the entire periphery. Consequently, it is advantageous for connecting with a joint or another pipe having a connecting portion having such a structure.

Further, sequences and the like other than described above are identical to the foregoing second embodiment, and so description will be omitted.

Still another modification will be described next.

A method of for producing a pipe in this modification relates to a method for forming a bulge machining on a curved pipe similar to the above described modification, however, the configuration of a flange differs slightly.

Figure 25A:
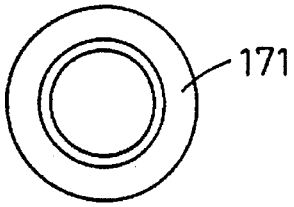
FIGS. 25A and 25B show an end portion of a pipe according to still another modification.
Figure 25B:
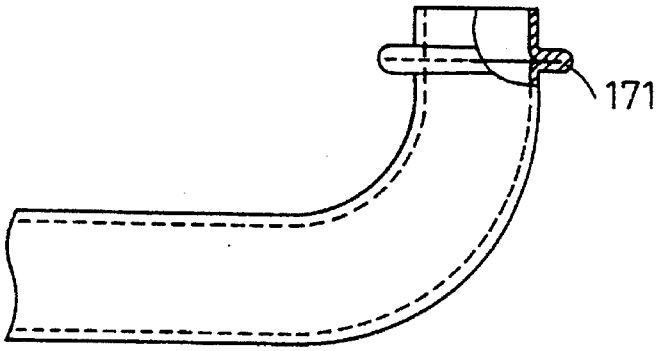

As shown in FIG. 25, a flange 171 formed by a method in this modification has a uniform radial dimension (circular configuration), but only thickness of an excess-pad portion side is increased. That is to say, the excess-pad portion can be absorbed into the flange configuration by a first jig (not illustrated) having a ring-shaped concavity corresponding to this flange configuration.

According to this modification, in particular, the flange 171 is formed in a circular configuration, and it is advantageous for connecting with a joint or another pipe having a connecting portion having a circular cross section perpendicularly to the axial direction.

Further, sequences and the like other than described above are identical to the foregoing second embodiment, and so description will be omitted.

Further, in the above-described embodiment and modifications, a flange of collar configuration was formed, but various flange configurations which can absorb an excess-pad portion may be adopted as appropriate.

Additionally, according to the above described embodiment and modifications, a method for forming the bulge includes three processes, namely, pipe widening, drawing and forming, but it may be possible to combine a process with the adjacent process and to reduce processes in accordance with workbility of the pipe to be used and configuration of the flange to be formed.

Furthermore, one flange is normally formed, but it is also acceptable to form a plurality of flanges depending on the case.

As shown in FIG. 25, a method which prevents buckling of the pipe wall to the inner-diameter side and absorbs irregular excess-pad portion by increasing pipe-wall thickness to correct irregularity of the pipe end by employing a mandrel to press the pipe end may be considered for a pipe having an irregular end surface, but when forming a bulge on such a pipe, the pad-thickness difference of the pipe is large, and this pad-thickness difference corresponds to a rigidity differential with respect to buckling. As a result, a difference occurs in deformation of the bulge portion, and configuration accuracy may be degraded. Since an O-ring may be fitted onto the pipe-end portion to connect to another pipe or pipe joint, high circularity is demanded. When there existed deformation as described above, sufficient circularity and sealing performance by the O-ring can not be obtained.

According to this embodiment, however, a pipe equipped with a flange, having a regularized pipe end, can be obtained by absorbing the irregular excess-pad portion into the flange configuration. Additionally, because increase in pipe-end thickness of the tip side from the flange can be suppressed to a minimum, occurrence of deformation due to a pipe-wall thickness difference can be suppressed. Therefore, pipe configuration (especially cylindricity of the outer peripheral surface) of the tip side from the flange can be formed with favorably accuracy, and thereby the connection with fitting components via an O-ring or the like can be performed favorably.

A seventh embodiment will be described next.

This embodiment, similarly to the above described sixth embodiment, relates to a method for forming a pipe having a joint connector to improve the fastening force, and further improves the productivity as compared with the sixth embodiment.

Firstly, a jig and the like used in the present embodiment will be described.

Figure 26A:
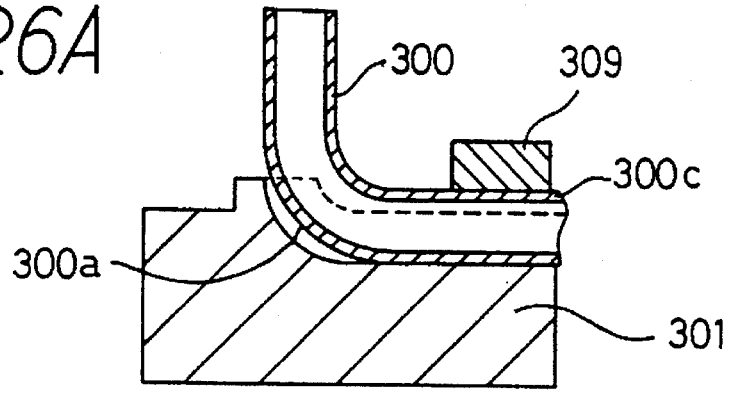
FIGS. 26A–26C are cross sectional views sequentially showing a second process of a producing method according to a seventh embodiment.
Figure 26B:
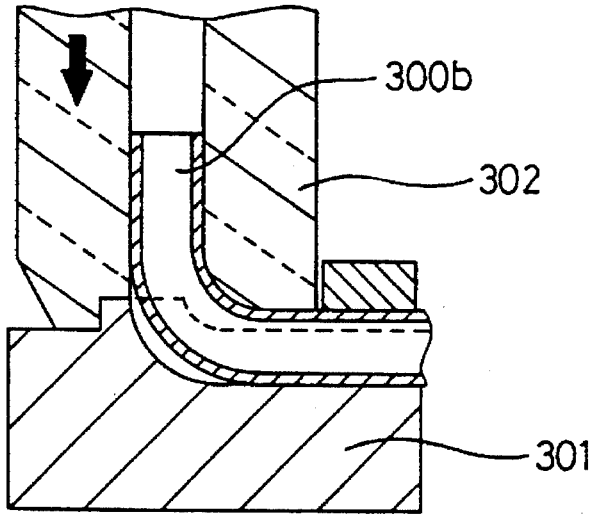
Figure 26C:
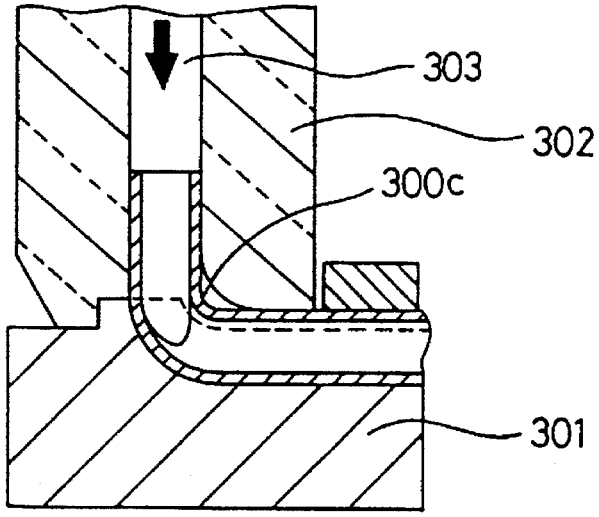

As shown in FIG. 26, a holding jig 301 for supporting a pipe 300 and fixedly holding a lower half, a sleeve 302 for holding a bend side wall of the pipe 300, and a punch 303 for pressing a pipe end surface are employed in a second process. Herein, the holding jig 301 for supporting and holding the lower half of the pipe 300 is of a configuration that can hold a side wall of the pipe 300.

Figure 27A:
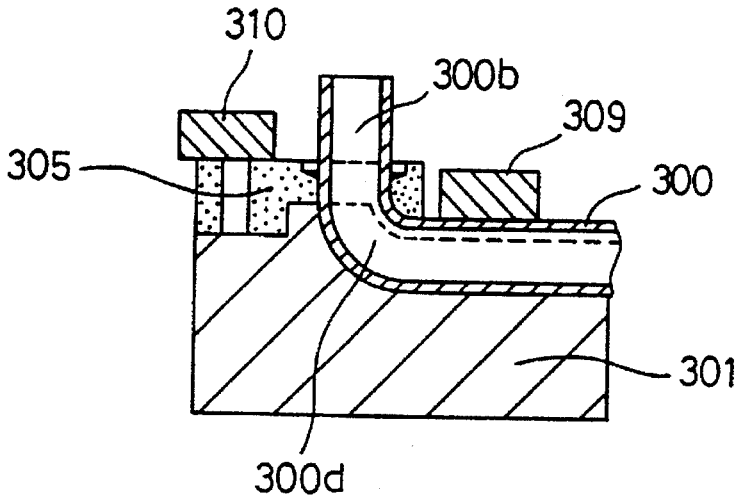
FIGS. 27A–27C are cross sectional views sequentially showing a third process of the producing method according to the seventh embodiment.
Figure 27B:
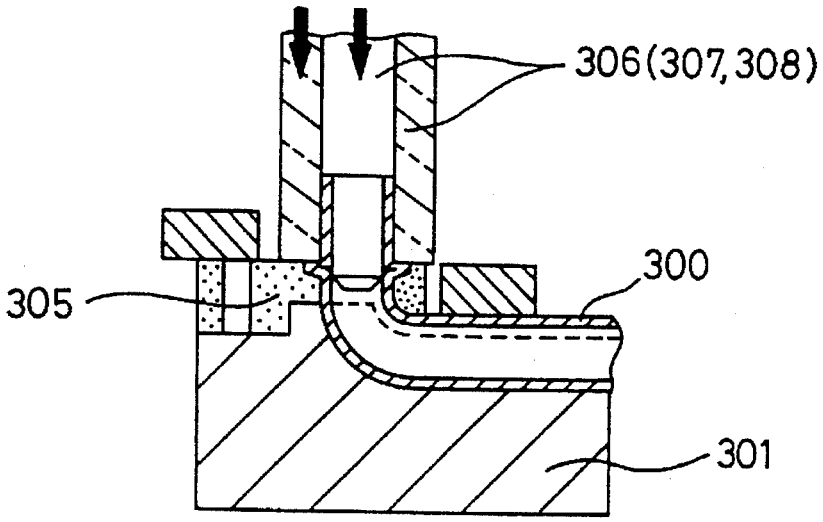
Figure 27C:
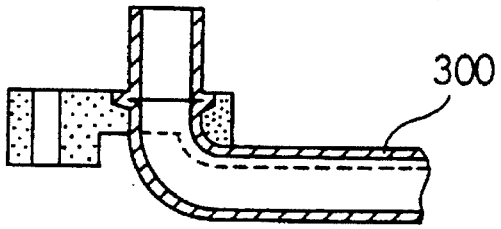
Figure 28:
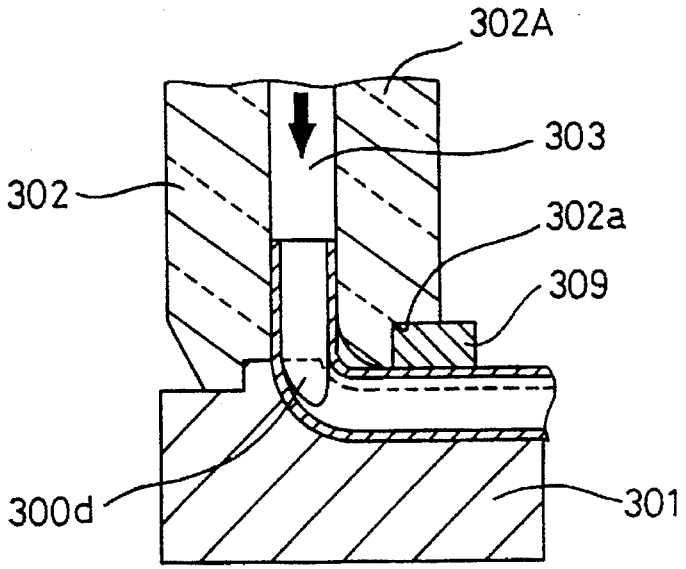
FIG. 28 is a cross sectional view showing a modification of the producing method according to the seventh embodiment.

Additionally, as shown in FIG. 27, the above described holding jig 301 for supporting and holding the lower half of the pipe 300 and punches 306, 307, and 308 to join a joint connector 305 than joined to the pipe 300 are employed as a device employed in a third process to form a pipe-end portion **300*b* of the pipe 300 in a state where the joint connector 305 has been inserted. Further, the punches 306, 307, and 308 are similar to the first embodiment. In addition, the joint connector 305 is such that it can be positioned and set above the holding jig 301**.

b) A method for producing the pipe according to this embodiment will be described next.

(1) The second process will be described firstly.

The second process is basically similar to the sixth embodiment; as shown in FIG. 26A, the pipe 300 is positioned in a groove **301*a* of substantially "<"-shaped configuration provided on a pipe configuration of the holding jig 301. Accordingly, in a state where the pipe 300 is fixedly held so that side surface of the pipe 300 is not widened, a long straight portion 300*a* of the pipe is pressed by a clamp 309 to fix the pipe 300**.

Next, in a state where a periphery of the pipe-end portion **300*b* of the pipe 300 has been fixed by the sleeve 302, as shown in FIG. 26B, the pipe 300 is bent to a small R with no buckling of a bend inner-side portion 300*c* by pressing the pipe-end portion (for example an end surface) 300*b* from a pipe-end direction by the punch 303, as shown in FIG. 26**C.

(3) Next, the third process will be described with reference to FIGS. 27A and 27B.

Next, as shown in FIG. 27A, the clamp 309 is moved toward an elbow portion **300*d* of the pipe 300 bent into a small-R configuration in the foregoing second process. Accordingly, the joint connector 305 is fitted on the pipe-end portion 300*b* side of the pipe 300, and the joint connector 305 is pressed at the holding jig 301 side and secured by another clamp 310**.

Next, the desired fitting configuration is obtained in this state by continuously lowering and pressing punches similar to those shown in FIG. 18.

Herein, side-wall of the pipe 300 can be fixedly held in this process by the holding jig 301 or the joint connector 305.

In this way, according to this embodiment, the holding jig 301 can be used commonly in the second process and the third process when producing by using the holding jig 301, sleeve 302, clamps 309 and 310, and so on. Therefore, an effect similar to the above described sixth embodiment is obtained, and the productivity can be further improved as compared with the sixth embodiment.

Furthermore, when the clamp 309 is installed close to the elbow portion **300*d* side of the pipe 300 in advance and a sleeve having a notch 302*a* at a portion which contacts the clamp is utilized as a sleeve 302A, as is shown in FIG. 21, it is not necessary to move the clamp 309** after the second process, thus further improving the productivity.

An eighth embodiment will be described next.

This embodiment, similarly to the above described seventh embodiment, relates to a method for producing a pipe having a joint connector to improve the fastening force, but differs in a configuration of the joint connector and the like.

Figure 29A:
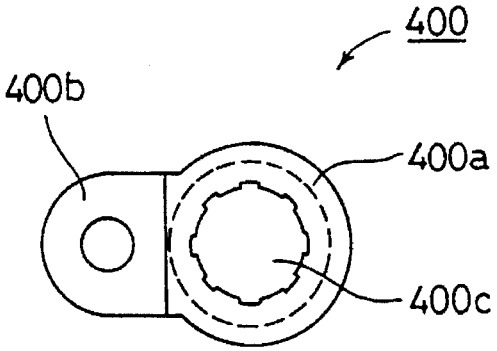
FIGS. 29A and 29B show a joint connector utilized in a producing method according to an eighth embodiment.
Figure 29B:
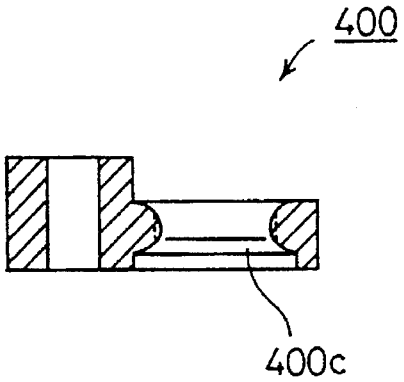
Figure 30A:
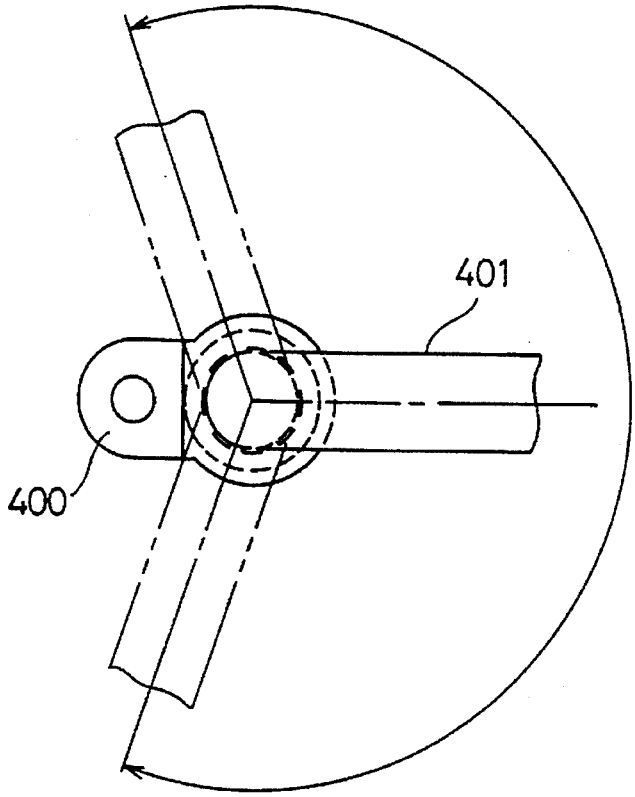
FIGS. 30A and 30B show a state of a pipe to which the joint connector according to the eighth embodiment has been connected.
Figure 30B:
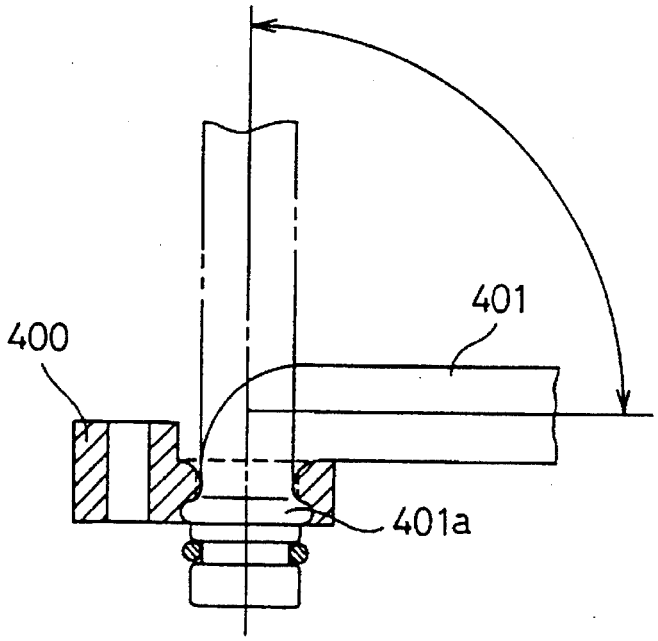

As shown in FIG. 29, a joint connector 400 of the present embodiment is configured such that two large and small cylindrical portions **400*a* and 400*b* are joined in a lateral direction, and the small cylindrical portion 400*b* is set to be thicker than the large cylindrical portion 400*a*. Additionally, an inner-side cross-section of a hole 400*c* of the large cylindrical portion 400*a* has an uneven portion of a substantially S-shaped configuration. Accordingly, as shown in FIG. 30, a pipe-end portion 401*a* of a pipe 401 is rotatably installed in the hole 400*c*, and the pipe 401** is thereby rotatable within a predetermined range.

Figure 31A:
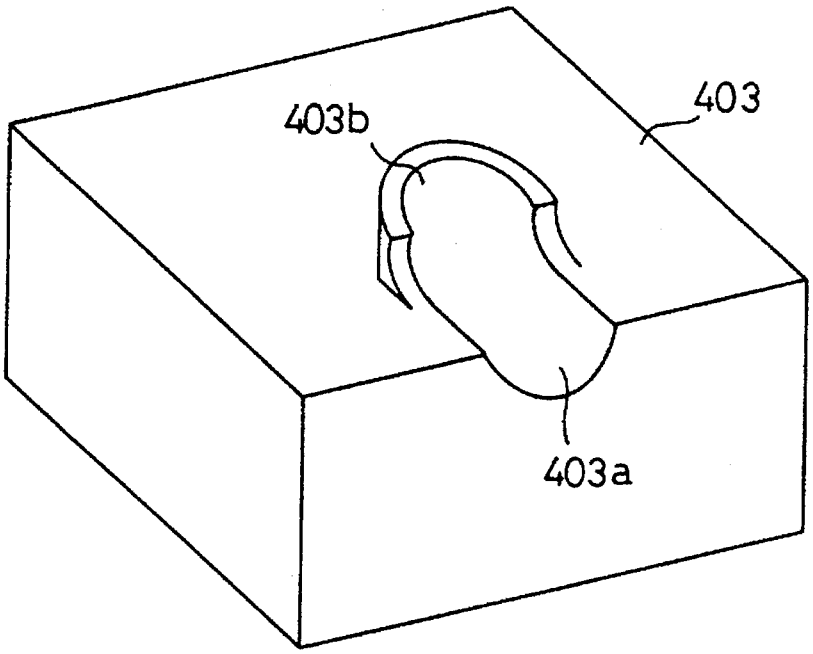
FIGS. 31A and 31B show a producing method according to a ninth embodiment.
Figure 31B:
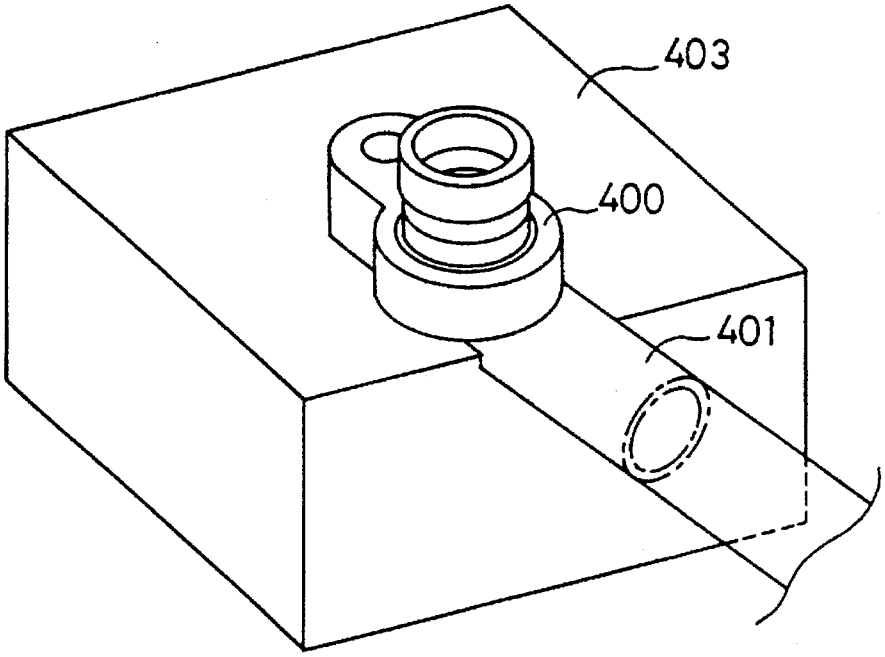

Additionally, as shown in FIG. 31A, a holding jig 403 utilized in this embodiment is provided with a groove **403*a* of a substantially "<"-shaped configuration and a protrusion 403*b*** of semicircular configuration.

Consequently, when the pipe 401 is produced, firstly the pipe 401 is positioned in this groove **403*a* of the holding jig 403**.

Figure 24B:
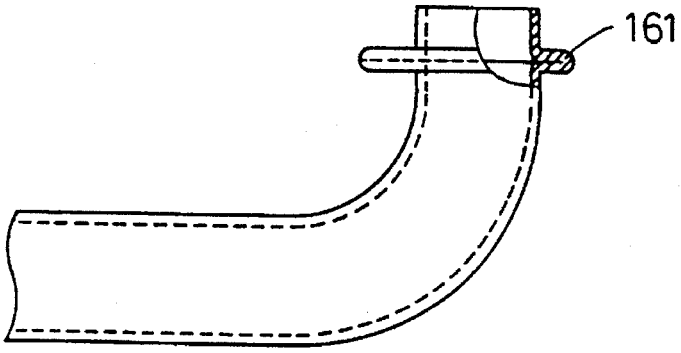

Accordingly, after performing a second process similarly to the above-described seventh embodiment, the joint connector 400 is mounted on the pipe-end portion 401 of the pipe 401, as shown in FIG. 24B, and a third process is performed in the same manner as the seventh embodiment.

According to this embodiment, since a joint connector 400 as described above is utilized, an effect similar to the seventh embodiment is obtained, and further, there is an advantage that the direction of the pipe 401 can be set freely.

That is to say, since a pipe 401 with joint connector 400 having a desired mounting angle is obtained by using the joint connecter 400 having one type of configuration and one type of the holding jig 403, the manufacturing cost can be greatly reduced.

Figure 32A:
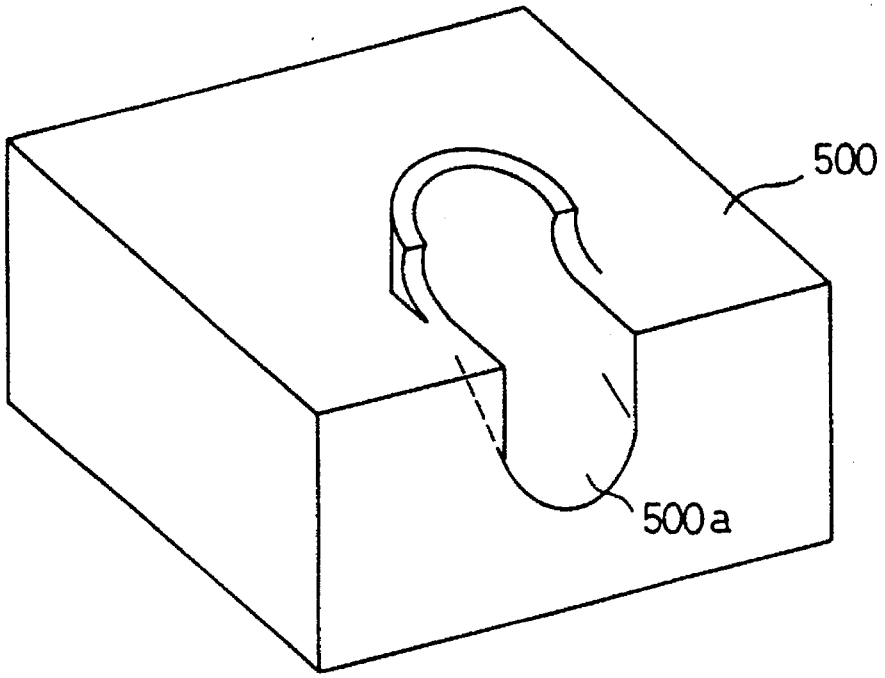
FIGS. 32A and 32B show a modification of the producing method according to the ninth embodiment.
Figure 32B:
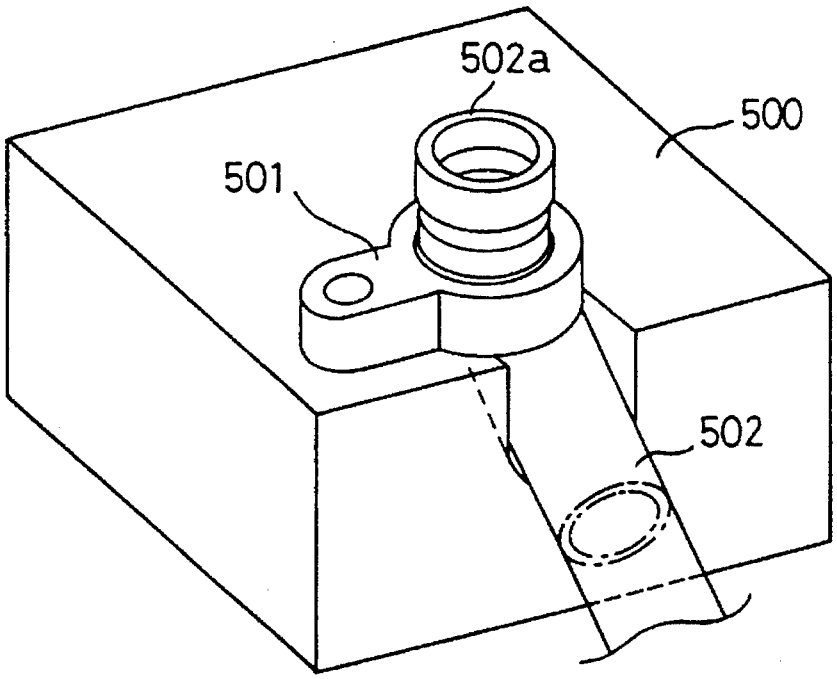

Additionally, when the pipe has been bent to an angle (bend angle) which is wider than a right angle, a holding jig 500 having an inclined groove 500*a* is utilized, as shown in FIG. 32A. That is to say, a pipe 502 is fitted into the groove 500*a*, pipe forming of the second step is performed, and thereafter a joint connector 501 is mounted on a pipe-end portion 502*a* of the pipe 502 and pipe forming of the third process can be performed, as shown in FIG. 32B. That is to say, the desired mounting angle and bend angle are obtained by a simple means, and there is an advantage that the manufacturing cost can be greatly reduced.

A ninth embodiment will be described next.

This embodiment, similarly to the above described eighth embodiment, relates to a method for forming a pipe having a joint connector to improve the fastening force, however, a configuration of the joint connector and the like is different.

Figure 33A:
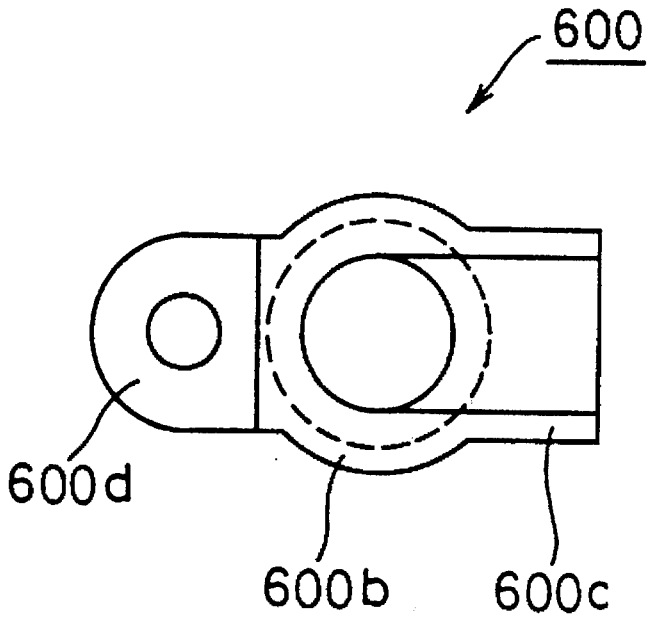
FIGS. 33A and 33B show another joint connector.
Figure 33B:
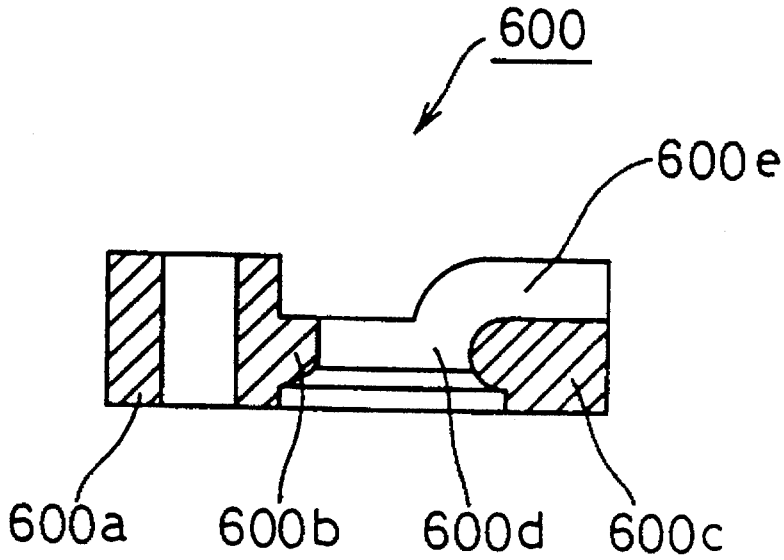

As shown in FIG. 33, a joint connector 600 of this embodiment is configured such that two large and small cylindrical portions 600*a* and 600*b* and a right-angle portion 600*c* have a laterally joined configuration, and the thickness of the large cylindrical portion 600*b* in the center is set to be thin. Additionally, a groove 600*e* corresponding to the pipe configuration extends from one end of a hole 600*d* of the large cylindrical portion 600*b* to the right-angle portion 600*c*.

Figure 34A:
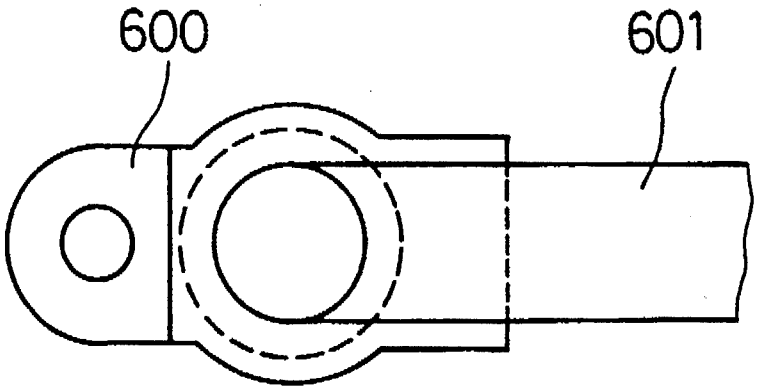
FIGS. 34A and 34B indicate a state of a pipe to which the other joint connector has been connected.
Figure 34B:
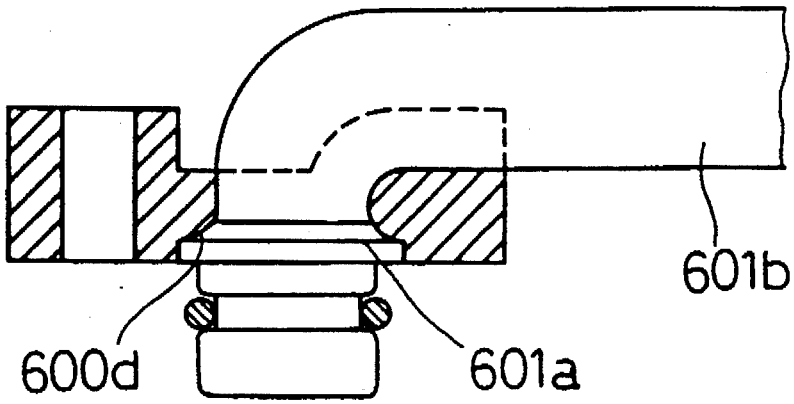
Figure 35A:
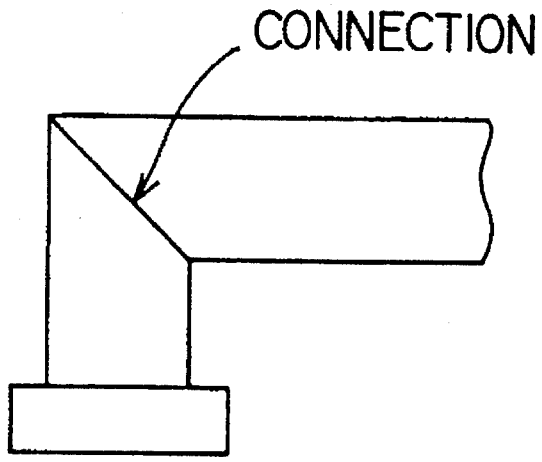
FIG. 35A PRIOR ART
FIGS. 35A and 35B are explanatory views showing the conventional pipe, respectively.
Figure 35B:
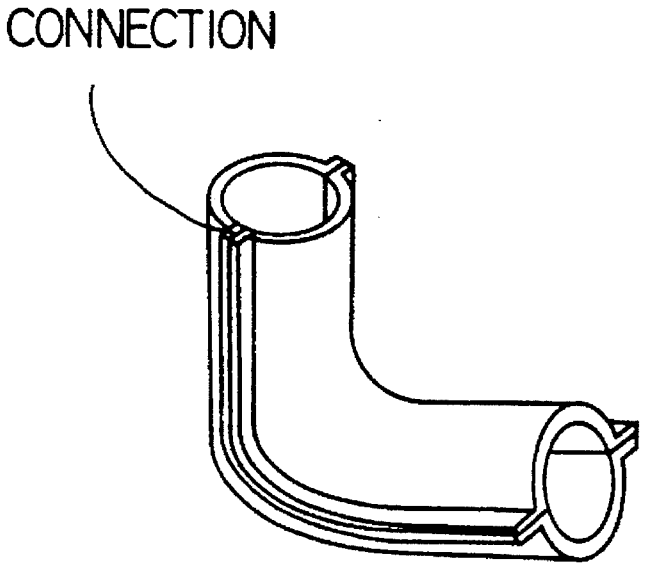
FIG. 35B PRIOR ART

Consequently, according to this embodiment, as shown in FIG. 34, a pipe-end portion 601*a* of a pipe 601 is mounted in the hole 600*d*, and a long straight portion 601*b* of the pipe 601 is fitted into the groove 600*e*, and rotation of the pipe 601 is restricted.

According to this embodiment, since the joint connector 600 described above is utilized, an effect similar to the seventh embodiment is obtained, and the pipe 601 can be securely fixed.

Furthermore, the present invention is in no way exclusively restricted to the above described embodiments, and needless to say may be embodied in various modes in a scope without departing from the essence of the present invention.

For example, a groove of knurling or the like may be performed on a surface in contact with the above-described joint connector.

Although the present invention has been fully described in connection with the preferred embodiment thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A method for producing a pipe comprising steps of:

a first process for bending a pipe to a predetermined radius of curvature to form a R elbow portion thereon; and a second process for bending said R portion with a smaller radius of curvature by pressing a pipe-end portion of said pipe in an axial direction thereof while fixedly holding side walls, which are positioned substantially perpendicularly to a plane in the direction where said pipe is bent, of said pipe to form a small R elbow portion.

2. A method for producing a pipe according to claim 1, wherein:

a radius of curvature of said small R portion is less than 1 tvp 5.5 D, where D is pipe diameter.

3. A method for producing a pipe according to claim 1, wherein:

a straight portion of a pipe-end side of said pipe is thrusted into a bend-direction inner side of said small R elbow portion in said second process, and a cross-sectional configuration of said thrusted-in portion is a substantially square configuration.

4. A method for producing a pipe according to claim 1 through 3, further comprising:

a third process for forming a pipe-end portion adopted to be fitted with another pipe while fixedly holding a bend side wall.

5. A method for producing a pipe according to claim 4, wherein:

said third process is a process for forming a bulge on said pipe-end portion.

6. A method for producing a pipe according to claim 5, wherein:

said second process includes:

holding a lower half of the pipe by a lower holding jig having a lower pipe-support portion such that a bend outer portion of said elbow portion and a lower surface of a straight portion of said pipe are supported, and holding an upper half of the pipe by an upper holding jig having an upper pipe-support portion such that a bend inner portion of the elbow portion and an upper surface of said straight portion of said pipe are supported; and said third process includes:

mounting a jig for forming a bulge on said lower holding jig.

7. A method for producing a pipe according to claim 5, wherein:

said process for forming a bulge is performed on an irregular pipe-end portion having an excess-pad portion to form a flange portion by pressing said pipe-end portion in an axial direction thereof such that said excess-pad portion is absorbed in said flange portion.

8. A method for producing a pipe according to claim 7, wherein:

said excess-pad portion of said irregular pipe-end portion is absorbed in said flange portion in a radial size or thickness thereof.

9. A method for forming a pipe according to claim 7, wherein:

said flange portion is formed by a jig having a ring-shaped concavity corresponding to said flange configuration, and volume V of said ring-shaped concavity is determined to by adding a volume VY of said excess-pad portion Y of said irregular pipe-end portion thereto.

10. A method for forming a pipe according to claim 7, wherein:

said flange portion is formed by a jig having a ring-shaped concavity corresponding to a flange configuration formed with a hole-shaped support portion corresponding to a pipe configuration, after said pipe having said irregular pipe-end portion has been disposed and fixed within said hole-shaped support portion of said jig, a pipe-widening forming is performed from a side of said irregular pipe-end portion to widen a diameter of said pipe and a drawing is sequentially performed from a side of said irregular pipe-end portion for said pipe, and when an end surface of said irregular pipe-end portion is pressed to form said flange portion, said excess-pad portion of said irregular pipe-end portion is absorbed into said flange configuration.

11. A method for producing a pipe according to claim 1, wherein:

said pipe having a substantially L-shaped configuration having said R portion produced in said first process is fixedly held by a holding jig, said holding jig includes an inner space for receiving said pipe and a holding wall for restricting an expansion of a bend side wall of said pipe in said second process in a direction substantially perpendicular to a bend-direction plane of said pipe.

12. A method for producing a pipe according claim 11, wherein:

said inner space includes a bending space having a curved space of a substantially arc-shaped configuration so as to cover a bend-direction outer-side portion of said R portion from an outer side.

13. A method for producing a pipe according to claim 1, wherein:

said pipe-end portion is pressed with a pressing member from a pipe-end side in said second process.

14. A method for producing a pipe according to claim 13, wherein:

said pressing member has an inner-side pressing portion which is inserted into a pipe inner portion from said pipe-end side and presses a pipe inner side surface of a bend-direction outer-side portion of said R elbow portion.

15. A method for producing a pipe according to claim 1, wherein:

said second process includes:

holding a lower half of the pipe by a lower holding jig having a lower pipe-support portion such that a bend outer portion of said elbow portion and a lower surface of a straight portion of said pipe are supported, holding an upper half of the pipe by an upper holding jig having an upper pipe-support portion such that a bend inner portion of the elbow portion and an upper surface of said straight portion of said pipe are supported, and pressing said pipe-end surface by a punch to form said elbow portion into a small-R configuration.

16. A method for producing a pipe according to claim 15, wherein:

said upper holding jig includes a through hole where said pipe-end portion is positioned, and said small-R configuration is formed by press-fitting a pressing member into said through hole.

17. A method for producing a pipe according to claim 15, wherein:

said lower holding jig includes an inner space formed in a configuration so as to fixedly hold bend-side walls of said elbow portion after said second process is performed.

18. A method for producing a pipe according to claim 1, further comprising:

attaching a joint connecter on an pipe-end portion after said second process is performed.

19. A method for producing a pipe according to claim 18, further comprising:

forming said pipe-end portion adopted to be fitted with another pipe while said joint connecter is attached thereto.

20. A method for producing a pipe according to claim 19, wherein:

said pipe and said joint connecter are fixed by a fixing jig.

21. A method for producing a pipe according to claim 1, wherein:

said second process includes:

holding a lower half of the pipe by a lower holding jig having a lower pipe-support portion such that a bend outer portion of said elbow portion and a lower surface of a straight portion of said pipe are supported, and sandwiching said pipe by pressing said pipe from an upper side of said lower holding jig with a clamp.

22. A method for producing a pipe according to claim 21, wherein:

said second process further comprises:

fitting a sleeve with said pipe-end of said pipe sandwiched between said lower holding jig and said clamp, said sleeve having a through hole, and forming said small-R configuration by press-fitting a pressing member into said through hole.

23. A method for producing a pipe according to claim 22, further comprising:

attaching a joint connecter on an pipe-end portion after said second process is performed, and forming said pipe-end portion adopted to be fitted with another pipe while said joint connecter is attached thereto.

* * * * *